US011267596B2

(12) United States Patent
Finzo et al.

(10) Patent No.: US 11,267,596 B2
(45) Date of Patent: Mar. 8, 2022

(54) STRAPPING DEVICE HAVING A PIVOTABLE ROCKER

(71) Applicant: Signode Industrial Group LLC, Glenview, IL (US)

(72) Inventors: Flavio Finzo, Wurenlos (CH); Mirco Neeser, Ehrendingen (CH); Dimitrios Takidis, Dubendorf (CH)

(73) Assignee: Signode Industrial Group LLC, Tampa, FL (US)

( * ) Notice: Subject to any disclaimer, the term of this patent is extended or adjusted under 35 U.S.C. 154(b) by 301 days.

(21) Appl. No.: 16/448,167

(22) Filed: Jun. 21, 2019

(65) Prior Publication Data

US 2019/0300214 A1 Oct. 3, 2019

Related U.S. Application Data

(60) Continuation of application No. 15/910,346, filed on Mar. 2, 2018, now Pat. No. 10,370,132, which is a (Continued)

(30) Foreign Application Priority Data

Sep. 24, 2012 (CH) ..... CH1723/12
Sep. 24, 2012 (CH) ..... CH1724/12

(51) Int. Cl.
*B65B 13/22* (2006.01)
*B65B 13/32* (2006.01)

(Continued)

(52) U.S. Cl.
CPC ..... *B65B 13/22* (2013.01); *B65B 13/02* (2013.01); *B65B 13/025* (2013.01);

(Continued)

(58) Field of Classification Search
CPC ..... B65B 13/02; B65B 13/025; B65B 13/18; B65B 13/187; B65B 13/22; B65B 13/32; B65B 13/322

(Continued)

(56) References Cited

U.S. PATENT DOCUMENTS 3,367,374 A 2/1968 Meier et al.
3,654,033 A 4/1972 Angarola et al.

(Continued)

FOREIGN PATENT DOCUMENTS

CA 2432353 A1 12/2003
CH 705745 A2 5/2013

(Continued)

OTHER PUBLICATIONS

"International Search Report and Written Opinion", International Application No. PCT/IB2013/002116 (8 pages), dated Jun. 30, 2014.

(Continued)

*Primary Examiner* — Jimmy T Nguyen
(74) *Attorney, Agent, or Firm* — Neal, Gerber & Eisenberg LLP

(57) ABSTRACT

Various embodiments of the present disclosure provide a mobile strapping device for strapping packaged products using a loop of wrapping strap. The strapping device includes a tensioning device for applying tension to the strap and a connecting device for connecting two overlapping portions of the strap. The tensioning device includes a rotatable tensioning wheel and a tensioning plate. The tensioning wheel is supported by a rocker that is pivotable to change a distance separating the tensioning wheel and the tensioning plate. The mobile strapping device includes a motor that is operably connectable to the rocker or the tensioning wheel such that the motor causes pivoting of the (Continued)

rocker or rotation of the tensioning wheel when operating in a first direction of rotation. In various embodiments, gearing, including a plurality of planetary gear sets, is used to operatively connect the motor to the rocker and the tensioning wheel.

20 Claims, 10 Drawing Sheets

Related U.S. Application Data division of application No. 14/430,163, filed as application No. PCT/IB2013/002116 on Sep. 24, 2013, now Pat. No. 9,938,029.

(51) Int. Cl.
*B65B 13/02* (2006.01)
*B65B 13/18* (2006.01)

(52) U.S. Cl.
CPC ..... *B65B 13/187* (2013.01); *B65B 13/32* (2013.01); *B65B 13/322* (2013.01)

(58) Field of Classification Search
USPC ..... 100/29, 32
See application file for complete search history.

(56) References Cited

U.S. PATENT DOCUMENTS 4,011,807 A 3/1977 Kobiella
4,015,643 A 4/1977 Cheung
4,050,372 A 9/1977 Kobiella
4,161,910 A 7/1979 Leslie et al.
4,240,865 A 12/1980 Kyts
4,313,779 A 2/1982 Nix
4,450,032 A 5/1984 Wehr
4,535,730 A 8/1985 Allen
4,572,064 A 2/1986 Burton
4,707,390 A 11/1987 Cheung
4,776,905 A 10/1988 Cheung et al.
5,105,130 A 4/1992 Barker et al.
5,133,532 A 7/1992 Figiel et al.
5,146,847 A 9/1992 Lyon et al.
5,155,982 A 10/1992 Boek et al.
5,159,218 A 10/1992 Murry et al.
5,165,532 A 11/1992 Pipich et al.
5,379,576 A 1/1995 Koyama
5,509,594 A 4/1996 Maggioni
5,516,022 A 5/1996 Annis
5,653,095 A 8/1997 Stamm
5,689,943 A 11/1997 Wehr
5,690,023 A 11/1997 Stamm et al.
5,798,596 A 8/1998 Lordo
5,809,873 A 9/1998 Chak et al.
5,831,404 A 11/1998 Ishii
5,853,524 A 12/1998 Nix
5,947,166 A 9/1999 Doyle et al.
5,954,899 A 9/1999 Figiel et al.
6,003,578 A 12/1999 Chang
6,073,664 A 6/2000 Angarola
6,079,457 A 6/2000 Crittenden
6,109,325 A 8/2000 Chang
6,173,747 B1 1/2001 Angarola et al.
6,260,337 B1 7/2001 Cheung
6,308,745 B1 10/2001 Angarola et al.
6,308,760 B1 10/2001 Finzo et al.
6,328,087 B1 12/2001 Finzo et al.
6,332,306 B1 12/2001 Finzo et al.
6,338,375 B1 1/2002 Harada
6,345,658 B1 2/2002 Shida et al.
6,405,766 B1 6/2002 Benjey
6,422,272 B1 7/2002 Crittenden
6,516,715 B1 2/2003 Reiche
6,533,013 B1 3/2003 Nix
6,554,030 B2 4/2003 Cheung et al.
6,568,158 B2 5/2003 Shibazaki et al.
6,578,337 B2 6/2003 Scholl et al.
6,584,891 B1 7/2003 Smith et al.
6,606,766 B2 8/2003 Ko
6,640,838 B2 11/2003 Finzo
6,644,713 B2 11/2003 Del et al.
6,698,460 B2 3/2004 Marsche
6,715,375 B2 4/2004 Nestler
6,729,357 B2 5/2004 Marsche
6,732,638 B1 5/2004 Rometty et al.
6,772,798 B2 8/2004 Cheung
6,817,159 B2 11/2004 Sakaki et al.
6,907,717 B2 6/2005 Nix
6,911,799 B2 6/2005 Jensen
6,918,235 B2 7/2005 Nix
6,957,678 B2 * 10/2005 Scholl ..... B65B 13/18 100/29
7,011,000 B2 3/2006 Kushida et al.
7,073,431 B1 7/2006 Chen
7,128,099 B2 10/2006 Finzo
7,155,885 B1 1/2007 Nasiatka et al.
7,157,882 B2 1/2007 Johnson et al.
7,204,187 B2 * 4/2007 Zeimetz ..... B65B 13/06 100/29
7,236,243 B2 6/2007 Beecroft et al.
7,249,862 B2 7/2007 Shirane
7,312,609 B2 12/2007 Schmollngruber et al.
7,350,543 B2 4/2008 Crittenden
7,455,080 B2 11/2008 Crittenden et al.
7,456,608 B2 11/2008 Kageler et al.
7,497,068 B2 3/2009 Nasiatka et al.
7,556,129 B2 7/2009 Nix
7,562,620 B1 7/2009 Nasiatka et al.
7,703,330 B2 4/2010 Miyazaki et al.
D629,321 S 12/2010 Neeser et al.
7,948,336 B2 5/2011 Park
D651,498 S 1/2012 Neeser et al.
D653,923 S 2/2012 Neeser et al.
8,198,839 B2 6/2012 Katou et al.
8,281,711 B2 10/2012 Haberstroh et al.
8,287,672 B2 10/2012 Neeser et al.
8,378,600 B2 2/2013 Katou et al.
8,967,217 B2 3/2015 Gardner et al.
9,174,752 B2 11/2015 Neeser et al.
9,193,486 B2 11/2015 Neeser et al.
9,233,457 B2 1/2016 Wanek et al.
9,248,553 B2 2/2016 Schurder et al.
9,254,932 B2 2/2016 Neeser et al.
9,272,799 B2 3/2016 Figiel et al.
9,284,080 B2 3/2016 Neeser et al.
9,315,283 B2 4/2016 Neeser et al.
9,387,573 B2 7/2016 Pearson
9,403,609 B2 8/2016 Bonifazi et al.
9,468,968 B2 10/2016 Figiel et al.
9,487,314 B2 11/2016 Finzo
9,586,708 B2 3/2017 Finzo
9,932,135 B2 4/2018 Finzo et al.
9,938,029 B2 4/2018 Finzo et al.
9,994,341 B2 6/2018 Amacker et al.
10,058,989 B2 8/2018 Chellew
2002/0100146 A1 8/2002 Ko
2002/0129717 A1 9/2002 Helland et al.
2002/0134811 A1 9/2002 Napier et al.
2003/0131570 A1 7/2003 Scholl et al.
2003/0145900 A1 8/2003 Jensen et al.
2003/0221566 A1 * 12/2003 Apel ..... B65B 13/22 100/29
2004/0050188 A1 3/2004 Richards et al.
2004/0206251 A1 10/2004 Nix
2005/0279198 A1 12/2005 Kushida et al.
2006/0108180 A1 5/2006 Grach et al.
2006/0192527 A1 8/2006 Kageler et al.
2008/0196911 A1 8/2008 Krapf et al.
2009/0013656 A1 1/2009 Nasiatka et al.
2009/0114308 A1 5/2009 Nelson et al.
2011/0056392 A1 3/2011 Neeser et al.
2011/0100233 A1 5/2011 Neeser et al.

(56) References Cited

U.S. PATENT DOCUMENTS

| | | | |
|---|---|---|---|
| 2011/0253480 | A1 | 10/2011 | Goodman et al. |
| 2012/0007748 | A1 | 1/2012 | Forgues et al. |
| 2012/0017780 | A1 | 1/2012 | Haberstroh et al. |
| 2012/0160364 | A1 | 6/2012 | Katou et al. |
| 2012/0210682 | A1 | 8/2012 | Gardner et al. |
| 2013/0092408 | A1 | 4/2013 | Oberheim |
| 2013/0186287 | A1 | 7/2013 | Vick et al. |
| 2014/0008090 | A1 | 1/2014 | Kokinelis et al. |
| 2014/0290179 | A1 | 10/2014 | Keller |
| 2014/0311363 | A1 | 10/2014 | Leppert |
| 2016/0046398 | A1* | 2/2016 | Neeser ..... B65B 13/025 100/2 |
| 2016/0107775 | A1 | 4/2016 | Amacker et al. |
| 2016/0159505 | A1 | 6/2016 | Widmer et al. |

FOREIGN PATENT DOCUMENTS

| | | | |
|---|---|---|---|
| CN | 2266566 | Y | 11/1997 |
| CN | 1253098 | A | 5/2000 |
| CN | 1055426 | C | 8/2000 |
| CN | 1660675 | A | 8/2005 |
| CN | 101164416 | A | 4/2008 |
| CN | 100460284 | C | 2/2009 |
| CN | 101422761 | A | 5/2009 |
| CN | 101486329 | A | 7/2009 |
| CN | 101585244 | A | 11/2009 |
| CN | 101870367 | A | 10/2010 |
| CN | 201957492 | U | 9/2011 |
| CN | 202100012 | U | 1/2012 |
| DE | 4014305 | A1 | 11/1991 |
| DE | 4204420 | A1 | 8/1993 |
| DE | 19751861 | A1 | 1/1999 |
| DE | 20321137.5 | U1 | 1/2006 |
| DE | 102005049130 | A1 | 4/2007 |
| DE | 102006007990 | A1 | 8/2007 |
| DE | 202011050797.1 | U1 | 11/2011 |
| EP | 0095643 | A2 | 12/1983 |
| EP | 0603868 | A1 | 6/1994 |
| EP | 0659525 | A2 | 6/1995 |
| EP | 0744343 | A1 | 11/1996 |
| EP | 1177978 | A1 | 2/2002 |
| EP | 1413519 | A1 | 4/2004 |
| GB | 1161827 | A | 8/1969 |
| GB | 2041869 | A | 9/1980 |
| GB | 2481724 | A | 1/2012 |
| JP | S541238 | B1 | 1/1979 |
| JP | S5638220 | A | 4/1981 |
| JP | H07300108 | A | 11/1995 |
| JP | H08258808 | A | 10/1996 |
| JP | H09283103 | A | 10/1997 |
| JP | 3054566 | U | 12/1998 |
| JP | 3044132 | B2 | 5/2000 |
| JP | 2003231291 | A | 8/2003 |
| JP | 2003534989 | A | 11/2003 |
| JP | 2003348899 | A | 12/2003 |
| JP | 2004108593 | A | 4/2004 |
| JP | 2004241150 | A | 8/2004 |
| JP | 2011518085 | A | 6/2011 |
| JP | 2011518088 | A | 6/2011 |
| RU | 1772784 | C | 10/1992 |
| RU | 2161773 | C2 | 1/2001 |
| RU | 2355821 | C1 | 5/2009 |
| TW | I276571 | B | 3/2007 |
| WO | 0189929 | A1 | 11/2001 |
| WO | 2006048738 | A1 | 5/2006 |
| WO | 2009129633 | A1 | 10/2009 |
| WO | 2009129636 | A1 | 10/2009 |
| WO | 2014072775 | A1 | 5/2014 |

OTHER PUBLICATIONS

Bender, "Lithium Ion Technology: Shaping Power Tool", Air Conditioning, Heating, and Refrigeration News, vol. 228, Issue 14, p. 18 (3 pages), Jul. 31, 2006.

Chinese Patent Office, "Chinese Office Action and Search Report", Chinese Application No. 201380061441.6 (9 pages), dated Feb. 1, 2016.

Emandi, Ali, "Brushless DC Motor Drives", Energy-Efficient Electrical Motors, 3rd ed., Para. 270-272, CRC Press & Marcel Dekker (3 pages), Aug. 1, 2004.

* cited by examiner

STRAPPING DEVICE HAVING A PIVOTABLE ROCKER

PRIORITY CLAIM

This application is a continuation application of, claims priority to and the benefit of U.S. patent application Ser. No. 15/910,346, filed on Mar. 2, 2018, which is a divisional application of, claims priority to and the benefit of U.S. patent application Ser. No. 14/430,163, filed on Mar. 20, 2015 as a 371(c) application of PCT/IB2013/002116, filed on Sep. 24, 2013, now U.S. Pat. No. 9,938,029, granted Apr. 10, 2018, which claims priority to and the benefit of Switzerland Patent Application No. 1723/12, filed on Sep. 24, 2012, and Switzerland Patent Application No. 1724/12, filed on Sep. 24, 2012, the entire contents of each of which are incorporated herein by reference.

BACKGROUND

The present disclosure concerns a strapping device, such as a mobile strapping device, for strapping packaged goods by way of a strap, which has a tensioning apparatus for applying a strap tension to a loop of a strap, wherein the tensioning apparatus is provided with a tensioning wheel which can be rotationally driven about a tensioning axis in a motorized manner, being configured to engage with the strap, the tensioning apparatus furthermore having a tensioning plate, wherein it is provided during a strapping process performed by the tensioning apparatus that a one or two-ply segment of strap is located between the tensioning wheel and the tensioning plate and makes contact with both the tensioning wheel and the tensioning plate, and moreover the tensioning wheel and/or the tensioning plate is arranged on a rocker which can pivot in a motorized manner about a rocker axis in order to either increase or decrease a distance between the tensioning wheel and the tensioning plate by way of a pivoting motion, as well as a connecting device to produce a permanent connection, especially a welded connection, at two superimposed regions of the loop of strap by way of a connecting element, such as a welded element, which is provided for the local heating of the strap Such strapping devices are used for the strapping of packaged goods by way of a plastic strap. For this, a loop of the particular plastic strap is placed about the packaged goods. As a rule, the plastic strap is pulled off from a supply roll. After the loop has been placed completely about the packaged goods, the end region of the strap overlaps with a segment of the loop of strap. The strapping device is now placed at this two-ply region of the strap, the strap being clamped in the strapping device, a strap tension is applied to the loop of strap by way of the tensioning apparatus, and a closure is produced between the two layers of strap by frictional welding on the loop. In this process, pressure is applied to the strap with a frictional shoe oscillating in the region of the two ends of the loop of strap. The pressure and the heat created by the motion melt the generally plastic strap locally within a short time. This produces a lasting connection between the two layers of strap, one which can only be loosened with great force. After this, or roughly at the same time, the loop is separated from the supply roll. The particular packaged goods have now been strapped.

Such strapping devices are intended for mobile use, during which the device is taken by the user to the particular place of use, where one should not be dependent on the use of energy supplied from the outside. The energy required for the intended use of such strapping devices in order to tension a strap about any given packaged goods and produce a closure is generally provided by an electric storage battery or by pressurized air in the case of known strapping devices. This energy produces the strap tension applied by way of the tensioning apparatus to the strap and a closure on the strap. Furthermore, such strapping devices are configured to join together only weldable plastic straps.

For mobile devices, a low weight is of special importance, in order to physically burden the user of the strapping device as little as possible when using the device. Likewise, for ergonomic reasons, the weight should be distributed as uniformly as possible over the entire strapping device, especially in order to avoid a concentration of weight in the head region of the strapping device. Such a concentration results in difficult handling of the device. Furthermore, the most ergonomical and user-friendly handling of the strapping device is always desired. In particular, the possibility of wrong operation and malfunction should be kept as low as possible.

In strapping devices of this kind, moreover, it should be ensured as a further aspect of functional safety that even after achieving rather high strap tensions little or no slip occurs between the tensioning wheel and the strap. Slip, on the one hand, can prevent the achieving of the possible strap tension values. But slip can also cause a longer time for the tensioning process and thus the overall strapping process. Moreover, due to the longer time of use of the particular strapping device per strapping operation and thus also the amount of energy needed per strapping operation, slip can also reduce the number of strapping operations for a single charge of the storage battery Finally, slip also means that the desired strap tension value might not be achieved and thus the strap is not sufficiently taut, which can constitute a safety risk. In order to avoid slip as much as possible or at least reduce it, the tensioning wheel is usually provided with teeth and pressed by a force against the tensioning plate. The pressing force for this in known solutions can result from a spring by which the rocker with the tensioning wheel arranged on it is pressed against the strap and the tensioning plate located underneath. However, these solutions cannot be satisfactory, especially when higher strap tensions need to be generated, since (as has been discovered) slip cannot be sufficiently reliably prevented in this way during the tensioning process.

Therefore, the problem which the present disclosure is supposed to solve is to create a mobile strapping device of the mentioned kind with high functional safety, in which the intended strap tensions can be applied to the strap in a save manner with as little slip as is possible.

SUMMARY

This problem is solved by the present disclosure in a strapping device of the mentioned kind in that during the transmission of the motorized driving motion to the tensioning wheel, preferably for as long as the tensioning wheel is engaging with the strap, by way of at least one transmitting device of the strapping device, a driving motion is transmitted to the rocker, which can be pivoted at least sometime during the course of the tensioning process, wherein the driving motion is intended to apply a torque to the rocker. According to the present disclosure, the torque applied to the rocker can be used to increase the pressing force of the tensioning apparatus against the strap. In one simple-design solution, the torque exerted on the rocker by transmitting device can come from a motor, whose driving moment increases the pressing force of the rocker against the strap in the course of the tensioning process. It is preferable for the motorized increasing of torque to occur especially during or after an increasing of the strap tension Advantageously, a motor is used for the generating of the motorized torque for the rocker that also performs other driving motions. Especially favorably, one utilizes the motor and its driving motion with which the tensioning wheel is also driven. On the one hand, this can make an additional motor unnecessary, while still performing the function according to the present disclosure. On the other hand, the motor torque which usually also increases with increasing strap tension can be utilized to increase the pressing force. This enables an especially simple design for variable pressing of the rocker against the strap, independent of the tension. The latter can be done proportionately to the particular existing strap tension.

According to another aspect of the present disclosure, which is also of independent significance, a torque can also be applied to the rocker and transmitted that is based on a force exerted on the tensioning apparatus by the strap at a point of engagement of the strap with the tensioning apparatus. This force, which is a reaction of the tensioning force applied by the driven tensioning wheel to the strap, can be tapped from a suitable place and be transmitted to the rocker by transmitting device. For the least possible structural expense, the strap tension force at the tensioning wheel itself which is acting on the tensioning wheel can also be utilized. In particular, this can be used as torque acting on the tensioning wheel at any given time, which is taken from the tensioning wheel to the transmitting device of the tensioning apparatus and transmitted by them to the rocker.

Thus, according to the present disclosure, it is provided in advantageous fashion that the motorized driving movement for the tensioning apparatus is also used at least indirectly as a reaction, making use of the rotational movement driven by the motor of the tensioning wheel as well as a pivoting capability of the rocker during the tensioning process, to transfer a torque tapped by the tensioning wheel in engagement with the strap by way of the transmitting device to the rocker in order to increase a pressing force of the tensioning apparatus against the strap.

In one embodiment of the present disclosure, a gearing of the tensioning apparatus by which a motorized driving movement for the tensioning wheel can be stepped up or down, can be part of or the entire transmitting device with which the force acting on the tensioning wheel and resulting from the strap tension is transmitted from the strap to the rocker.

According to another aspect, the present disclosure can also be seen in that devices are provided for the variable pressing of the tensioning wheel or the tensioning plate against the strap, depending on the strap tension. Thus, the present disclosure calls for a variable pressing of the tensioning apparatus against the strap, depending on the strap tension.

In especially advantageous embodiments of the present disclosure, the strap tension created by the tensioning process is thus used advantageously to increase as well the pressing force of the tensioning wheel and/or the tensioning plate on the strap as the strap tension increases steadily, thereby working against the constantly increasing danger, as the strap tension likewise increases, of a "slip-through" or slippage of the tensioning wheel during the tensioning process. Thus, as the strap tension increases, so too does the pressing force of the tensioning wheel against the strap and the tensioning plate. The present disclosure in such embodiments thus makes it possible to exert a high pressing force on the strap when the strap tension is already high and thus the danger of slippage between the tensioning wheel and the strap is likewise especially high if it is attempted to further increase the strap tension. Thanks to the likewise increasing pressing force in automated manner, i.e., without manual intervention, one can counteract the increasing danger of slippage and thus ensure the functional safety as well as a rapid strapping process even with high strap tension. Since the reaction of the strap to the action, namely, the strap tension introduced, as well as transmitting devices are used for this, which are derived from the tensioning apparatus, especially the tensioning wheel, and transmitted to the rocker, no intervention by the user is needed to achieve the action of the present disclosure, which is advantageously accomplished automatically in the strapping device.

In one embodiment of the present disclosure, the transmitting device, which advantageously constitute an operative connection between the tensioning wheel and the rocker, comprise a pivoting mounting of the rocker at least during the tensioning process and a rotary or rotationally mounted gearing element, which stands in an operative connection with the tensioning wheel during the tensioning process. The force of reaction of the strap is utilized as a torque and transferred to the rotary or rotational gearing element, such as a planet carrier of a planetary gearing. The rotary or rotational gearing element should be propped against a support element to resist the turning or rotating movement. The force of reaction of the tensioning wheel can then be transferred to the rocker through or by virtue of the support, so that an additional torque will act on the rocker, which can be utilized to increase the pressing force of the rocker against the strap. The transmitting device can advantageously be part of or the entire tensioning gearing by which a motorized driving movement or one coming from another energy supply source is directed with suitable rotational speed toward the tensioning wheel.

In an embodiment of the present disclosure, which also has independent significance, motorized driving movements can be utilized with identical directions of rotation of the only one motor not only to drive the tensioning wheel during the tensioning of the strap but also for a lifting of the rocker. In addition to this, the same driving movement can also be used for the variable pressing of the tensioning wheel against the strap being tensioned, independence on the strap tension. The dependency is organized in this case such that, with increasing strap tension, the pressing force exerted by the tensioning wheel on the strap also increases. Since with increasing strap tension the danger also increases of a slippage occurring between the tensioning wheel and the strap, one can counteract the danger of slippage by providing an increasing pressing force. In this embodiment the same direction of turning of the motor as for the tensioning is used. The motorized driving movement during the tensioning of the strap can be utilized such that, during the tensioning process of the strap by way of the tensioning wheel engaging with the strap and rotating against a strap tension, a counterforce acting from the strap to the tensioning wheel is utilized to increase the pressing force of the tensioning wheel in the direction of the tensioning plate.

According to another aspect of the present disclosure, it should be made possible with little design expense and easy operating capacity to maintain and release a force resulting from the strap tension and operating reactively on a gearing in order to transfer a driving movement to the tensioning wheel. The present disclosure thus concerns a locking device for use in a strapping device, with which a rotatable wheel can be clamped, which is provided for transmission of a driving movement, especially a gearing wheel of a tensioning apparatus of the strapping device. The locking device according to the present disclosure should have at least one clamping body which can pivot about an axis and is arranged at a distance from the wheel, which can be pivoted from a release position into a locking position in which it bears by a portion of an arc-shaped contact surface against an essentially planar peripheral clamping surface of the wheel, i.e., one which is free of form-fitting elements, wherein the clamping body has a pivot radius which is greater than a distance from the pivot axis of the clamping body to the peripheral clamping surface of the wheel, and the rotating of the clamping body about the pivot axis during the movement from the release position to a clamping position occurs in the opposite direction of turning to that of the wheel being clamped.

With such a locking device, one can accomplish very functionally secure locking of rotating gear wheels in a simple designed manner. The locking in the direction of turning of the wheel can be maintained with little force expenditure. The clamping force of the clamping body even increases automatically if one should try to turn the wheel further by increasing the torque.

The locking mechanism according to the present disclosure can be used with advantage especially for the releasable locking of a wheel of a gearing which belongs to a gearing by which a driving movement is supposed to be transmitted to a tensioning wheel of the tensioning apparatus of a strapping device. In this context, it can be provided especially for the clamping of a wheel of a planetary gearing by which the driving movement is to be transmitted to the tensioning wheel. With or at least assisted by a clamping of the wheel being clamped, one can define one of at least two takeoff directions of the gearing, in particular a takeoff direction of the gearing toward the tensioning wheel, so that the strap can be tensioned.

Moreover, it can be advantageous with a loosening of the clamping to also remove at least partly, or entirely, the strap tension acting on the tensioning wheel and the gearing. Since with such locking mechanisms relatively low release forces are needed to remove the clamping, even for high strap tension values, the present disclosure produces especially functionally safe and easy to operate strapping devices. The low operating and activating forces make it possible to do without a rocker handle, with which large torques have been produced heretofore in known strapping devices for lifting the rocker from the taut strap. Instead of a long rocker handle, one can now use a button or switch with which the tension releasing process occurs.

Other embodiments of the present disclosure will emerge from the claims, the specification, and the drawing.

BRIEF DESCRIPTION OF THE DRAWINGS

The present disclosure shall be explained more closely with the help of sample embodiments represented schematically in the figures. There are shown.

DETAILED DESCRIPTION

Figure 1:
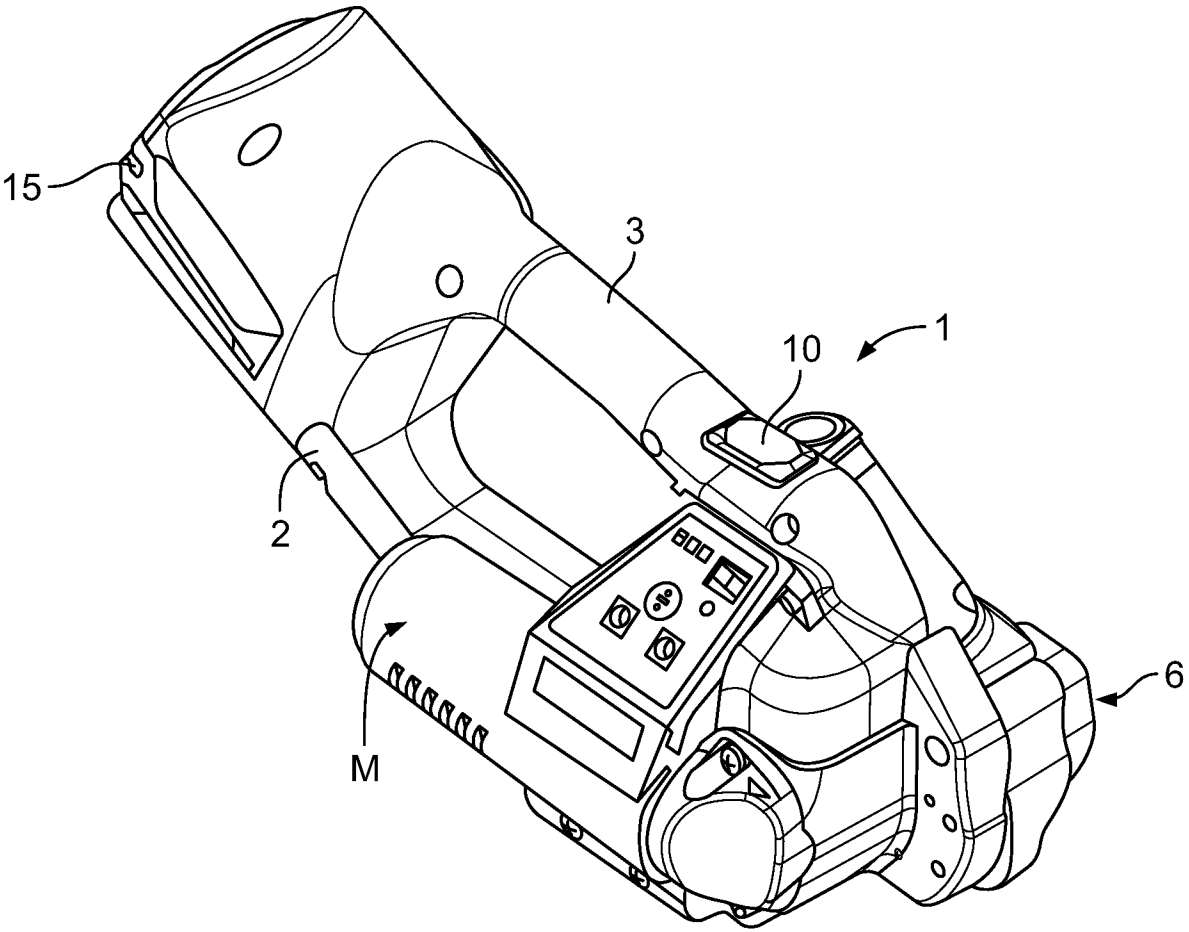
FIG. 1 a strapping device according to the present disclosure in a perspective representation.
Figure 2:
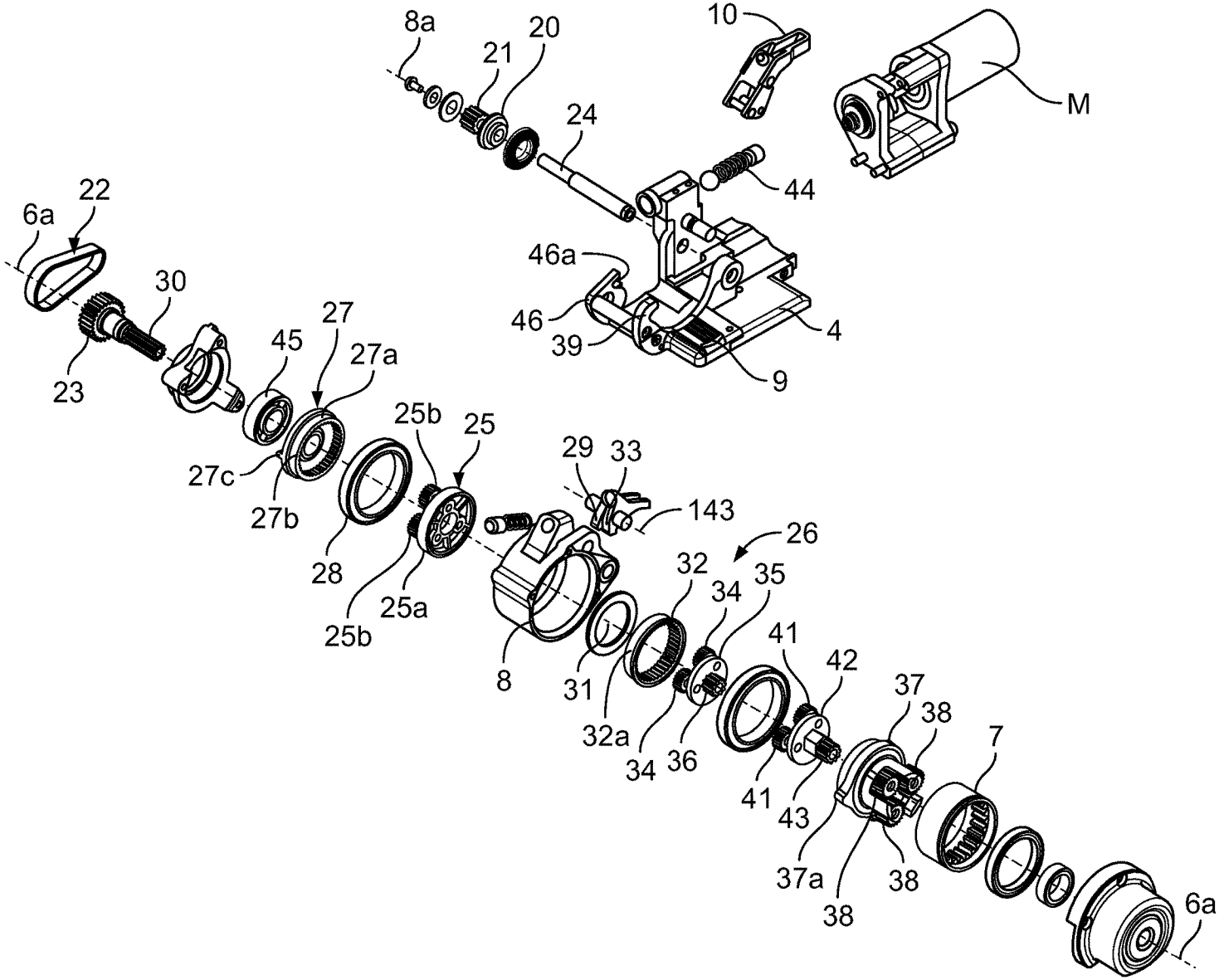
FIG. 2 an exploded representation of the tensioning apparatus of the strapping device from FIG. 1 with the motor.

The strapping device 1 shown in FIGS. 1 and 2, being exclusively manually operated, has a housing 2, which encloses the mechanism of the strapping device and on which a handle 3 is fashioned for handling the device. The strapping device, moreover, is provided with a base plate 4, whose bottom side is provided for being placed on an object being packaged. All the functional units of the strapping device 1 are fastened to the base plate 4 and to the carrier connected to the base plate, not otherwise depicted.

With the strapping device 1, one can tension a loop of plastic strap B, not otherwise shown in FIG. 1, for example, one made of polypropylene (PP) or polyester (PET), which has previously been placed around the object being packaged, by way of a tensioning apparatus 6 of the strapping device. For this, the tensioning apparatus has a tensioning wheel 7, with which the strap B can be grasped for a tensioning process. The tensioning wheel 7 is arranged on a pivoting rocker 8, which can swivel about a rocker pivot axis 8*a*. The tensioning wheel 7, arranged with its axis of rotation at a distance from the rocker pivot axis 8*a*, can be moved by a pivoting motion of the rocker 8 about the rocker pivot axis 8*a* from one end position with a distance from a curved tensioning plate 9 arranged on the base plate 4 to a second end position in which the tensioning wheel 7 is pressed against the tensioning plate 9. By a corresponding motor-driven movement in the reverse direction of rotation about the rocker pivot axis 8*a*, the tensioning wheel 7 can be removed from the tensioning plate 9 and swiveled back to its starting position, such that the strap located between the tensioning wheel 7 and the tensioning plate 9 is released for removal.

During use of the indicated embodiment of tensioning device, two layers of the strap are situated between the tensioning wheel 7 and the tensioning plate and are pressed by the tensioning wheel 7 against the tensioning plate. By rotation of the tensioning wheel 7, it is then possible to provide a sufficiently large strap tension to the strap loop for packaging purposes. The tensioning process and the tensioning device and rocker 8 advantageously designed for this shall be explained more closely below.

After this, a welding of the two layers can be done in familiar fashion at a location of the strap where the two layers of the strap loop are superimposed on each other, by way of the friction welding device 12 of the strapping device. In this way, the strap loop can be permanently closed. In the sample embodiment shown here, the friction welding and separating mechanism 12 is actuated by the same only one motor M of the strapping device with which all other motor-driven movements are also performed. For this, in familiar manner, there is provided a not otherwise depicted freewheeling in the direction of transmission from the motor M to the places where the motorized driving movement occurs, which has the effect that the driving movement is transmitted in the particular desired rotary driving direction to the corresponding functional unit of the strapping device and no transmission occurs in the other particular rotary driving direction of the motor.

The friction welding device 12 for this is provided with a welding shoe 13, shown only highly schematized, which is moved by way of a transmission mechanism 14 from a position of rest at a distance from the strap to a welding position in which the welding shoe is pressed against the strap. The welding shoe pressed by mechanical pressure against the strap in this way and the simultaneously occurring oscillating movement of the welding shoe with a predetermined frequency melts the two layers of the strap. The locally plasticized or melted regions of the strap B flow into one another and after a cooldown of the strap B there is produced a connection between the two strap layers. Insofar as is necessary, the strap loop can then be separated from the supply roll of strap by way of a cutting device of the strapping devices 1, not otherwise depicted.

The in feed of the tensioning wheel 7 in the direction of the tensioning plate 9, the rotary driving of the tensioning wheel 7 about the tensioning axis 6*a*, the lifting of the tensioning wheel from the tensioning plate, the infeed of the friction welding device 12 by way of the transmission mechanism 14 of the friction welding device 12 as well as the use of the friction welding device 12 in itself and the activating of the cutting device occur by use of only a single common electric motor M, which provides each time a driving movement for these components of the strapping device. For the power supply of the motor M, a replaceable storage battery 15 is arranged on the strapping device, especially one which can be removed for recharging, which serves to store up electrical energy. A supply of other external auxiliary energy such as pressurized air or other electricity can be provided, but does not occur in the case of the strapping device per FIGS. 1 and 2.

Figure 4:
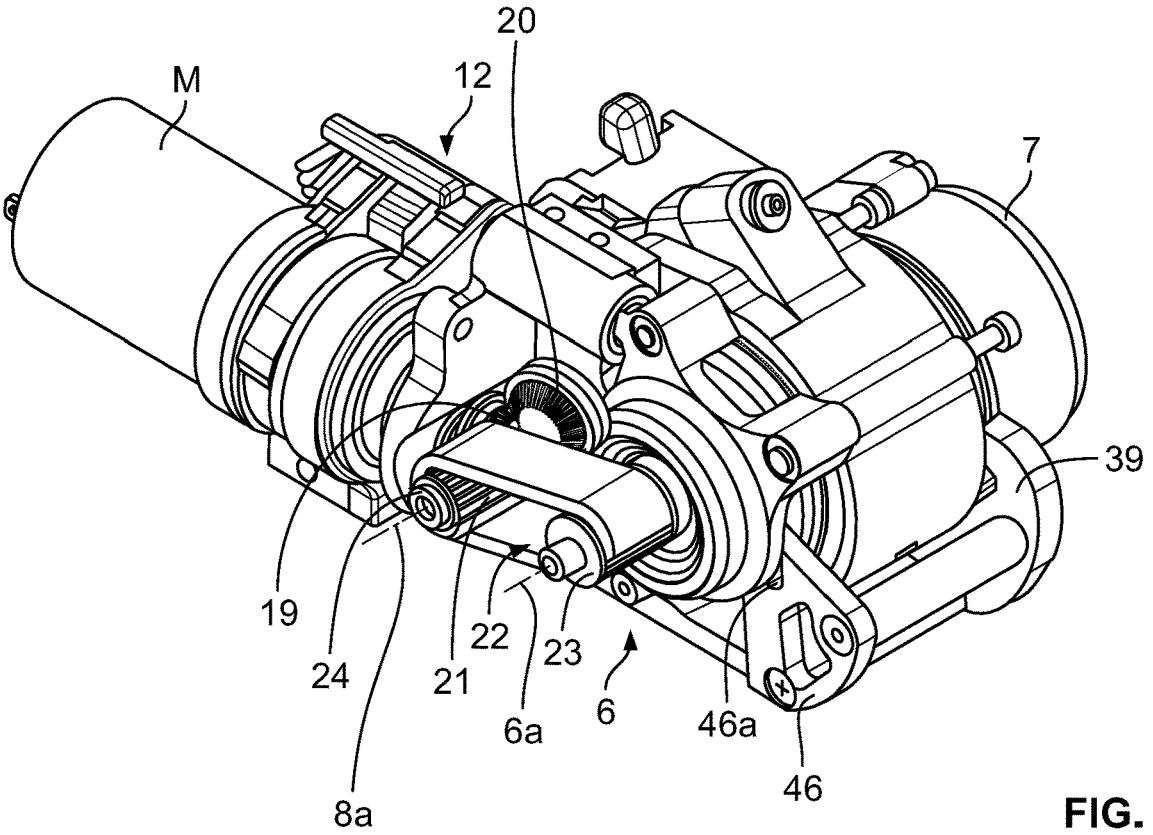
FIG. 4 another perspective representation of the tensioning and closure mechanism of the strapping device from FIG. 1.
Figure 5:
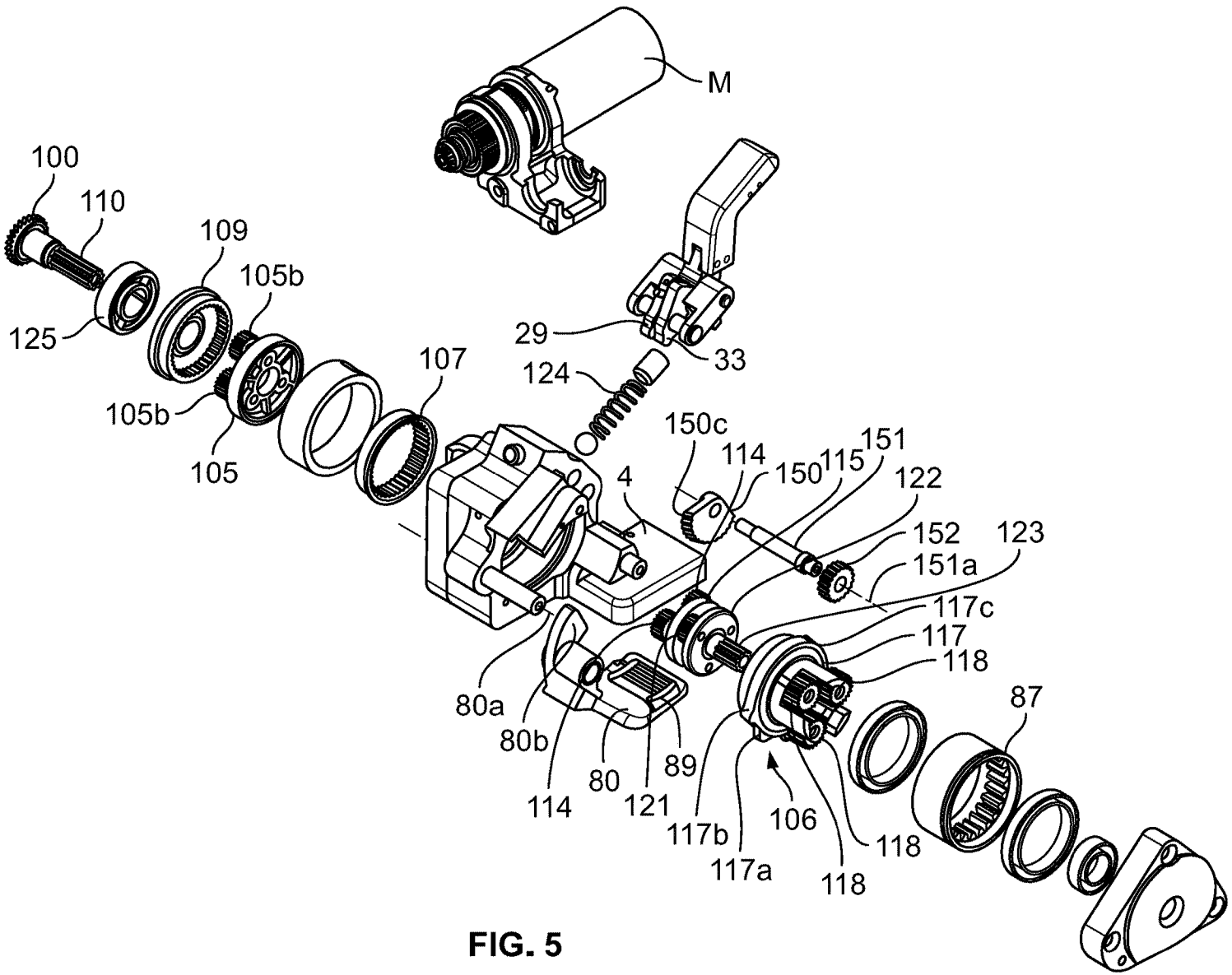
FIG. 5 an exploded representation of another sample embodiment of the tensioning apparatus of the strapping device from FIG. 1 together with the motor.
Figure 6:
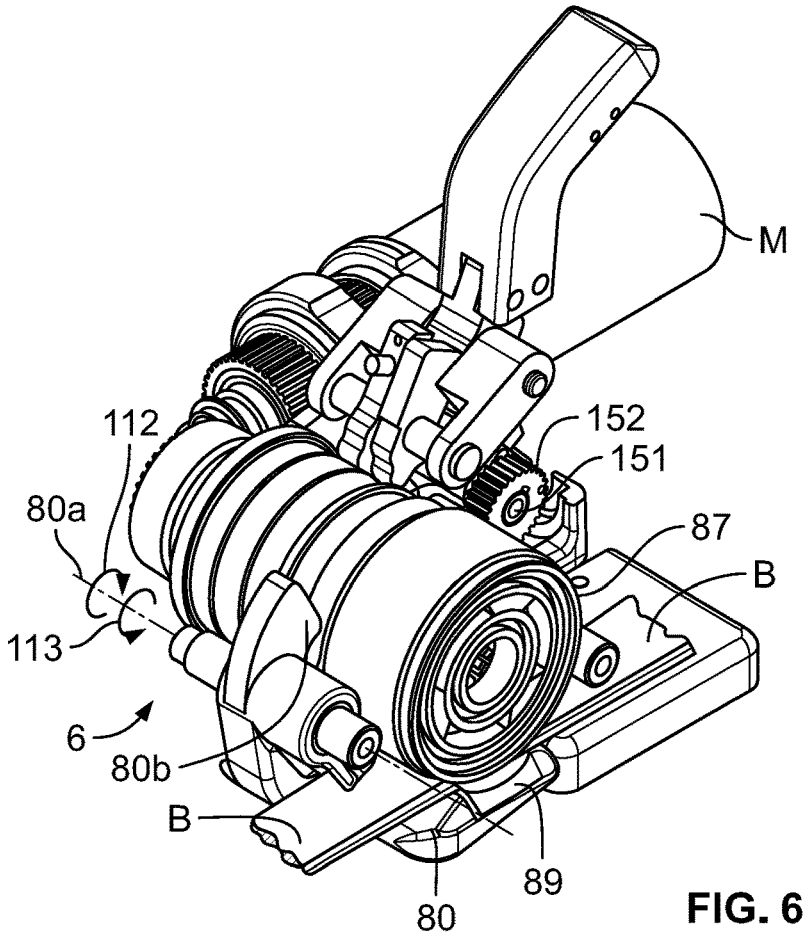
FIG. 6 a perspective representation of the tensioning and closure mechanism of the strapping device from FIG. 1.
Figure 7:
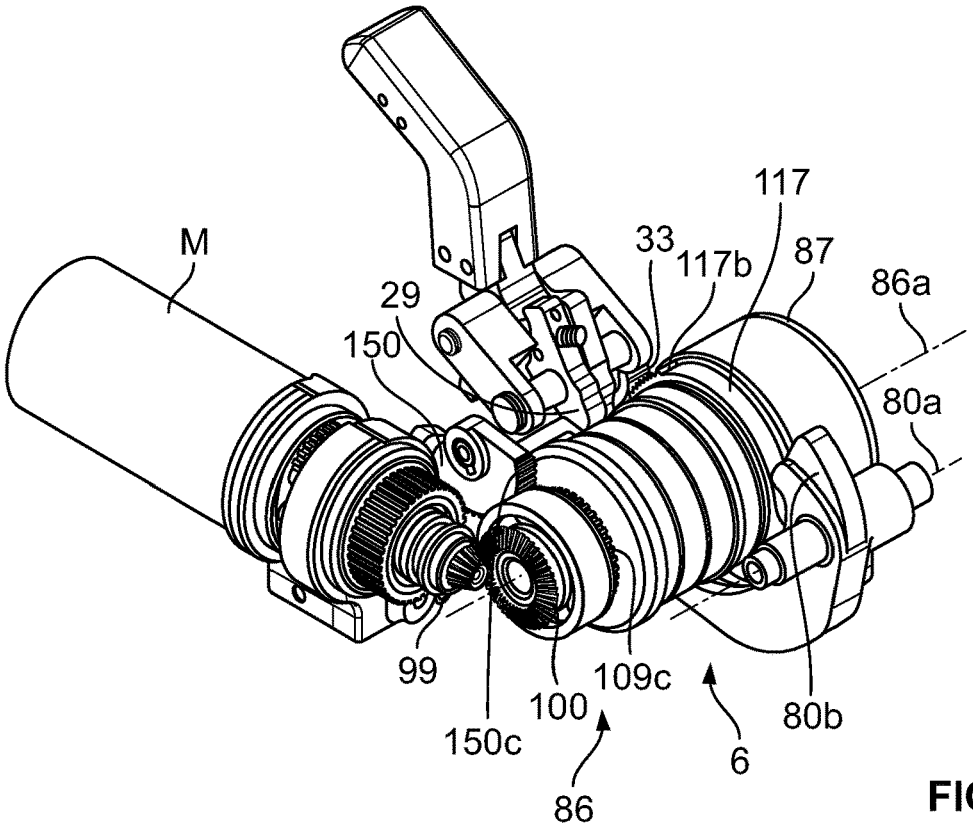
FIG. 7 another perspective representation of the tensioning and closure mechanism of the strapping device from FIG. 1.

As shown in FIG. 4, the strapping device according to the present disclosure provides for a tapping of the driving movement of the motor M at two places of its drive axis, either for the tensioning apparatus 6 or for the friction welding device 12. For this, the motor M can be operated in either of the two rotary directions. The shifting of the transmission of the driving movement to the tensioning apparatus 6 or to the friction welding device 12 is done automatically by a freewheeling arranged on the drive shaft of the motor M (and not otherwise shown) independence on the rotary direction of the drive shaft of the motor. In one rotary direction of the drive shaft, the driving movement is transmitted to the tensioning apparatus 6. Thanks to the freewheeling, the friction welding device 12 experiences no driving movement in this case. In the other rotary direction, the tensioning apparatus 6 has no driving movement and the friction welding device 12 is driven. No manual shifting is required in this embodiment for changing the direction of transmission of the motorized driving movement. Such freewheeling in connection with a strapping device is already known, and so it shall not be further discussed here.

As is likewise shown in FIG. 4, the motorized transmission of the driving movement to the friction welding device 12 and transmission mechanism 14 occurs by any suitable manner. This might be, for example, a toothed belt drive with a toothed belt closed into a ring. One of the two gears is arranged on the drive shaft of the electric motor M, the other one belongs to a gearing of the friction welding device 12, by which the motorized driving movement moves both the transmission mechanism 14 and the welding shoe 13 of the friction welding device 12. In this way, the welding shoe pressed against two overlapping layers of the strap can be placed in an oscillatory movement with predetermined frequency and amplitude, by which the two strap layers are locally melted in the region of the welding shoe and welded together by the subsequent cool down.

On the drive shaft of the motor, situated behind the toothed belt drive for the welding mechanism as seen from the motor M, there is a bevel gear 19, which belongs to a bevel gearing of the tensioning apparatus, as does a second bevel gear 20 meshing with it. On the same shaft where the second bevel gear 20 is arranged there is also located a first gear 21 of another toothed belt drive 22, which is furthermore led across a second gear 23. The first gear 21 of the toothed belt drive 22 is arranged on the shaft 24 firmly against rotation.

On the other end of the shaft 24 is mounted the rocker 8 of the strapping device, being part of the tensioning apparatus 6 and also carrying an upstream gearing from the tensioning wheel 7, in the present case a planetary gearing 26, for which suitable bearing sites can be provided on the rocker 8. The rocker 8 is shoved onto the shaft 24 such that the rocker 8 is arranged and supported so that the rocker 8 can pivot about the longitudinal axis of the shaft 8. The longitudinal axis of the shaft 24 is thus at the same time the rocker pivot axis 8*a*, about which the rocker 8 can swivel.

The planetary gearing 26 can be configured as a single or multiple-stage planetary gearing, in particular, a two or three-stage planetary gearing. From an end face of the gear 23 facing the tensioning wheel 7, there sticks out an externally toothed input sun gear 30 belonging to the planetary gearing 26, whose axis of rotation is identical to the axis of rotation 6*a* of the input gear 23. On a shaft of the gear 23 on which the sun gear 30 is also configured in the sample embodiment, a freewheeling 45 is provided, which only enables one rotary direction of the sun gears 30, namely, the rotary direction which is provided for the driving of the tensioning wheel. The sun gear 30 is led through a ring gear 27 and through a central recess of a planet carrier 25, which are likewise part of the planetary gearing 26. Looking from the input side of the planet gear, the planet carrier 25 is arranged behind the ring gear 27 on the axle of the planetary gearing 26 corresponding to the tensioning axis 6*a*. The planet carrier could also be configured as a clamping, coupling or spur gear.

The ring gear 27 has at its outer circumference a cam 27*c*, which engages with an abutment 46 secured to the base plate 4 of the strapping device. The internally toothed ring gear 27 is supported in this way so that the cam 27*c* can execute slight relative movements within its engagement with the abutment 46, for example, in a recess 46*a* of the abutment. Furthermore, the ring gear 27 has a ring-shaped shoulder 27*a*, on which a roller bearing 28 is arranged for the mounting of the planetary gearing 26.

The planet carrier 25, whose axis is aligned with the tensioning axis 6*a*, engages by its three planet gears 25*b* with an internal toothing of the input ring gear 27 of the planetary gearing 26. The planet gears 25*b* of the planet carrier 25 furthermore engage with the sun gear 30, from which they can obtain a driving movement and transmit it, appropriately stepped down, to the ring gear 27. Thus, given a rotationally fixed arrangement of the planet carrier 25, a rotational movement of the sun gear 30 can be converted into a rotational movement of the ring gear 27. In the sample embodiment, a first clamp 29 of a locking mechanism is configured as a pivoting cam, which can be brought into contact with a clamping surface 25*a* on the outer circumference of the planet carrier 25 or pivoted away from the clamping surface 25*a* with a spacing. The cam is arranged so that, upon contact of the cam with the clamping surface 25*a* by a rotation of the input planet carrier 25 in the rotary direction provided for the planet carrier 25, the clamping action is further intensified. By an infeeding of the cam onto the clamping surface 25*a* by a corresponding shifting movement, the planet carrier 25 can be blocked against rotation. By another shifting movement, the cam 29 can be moved away from the clamping surface 25*a*, thereby releasing the planet carrier 25 for rotational movements. The shifting movement can trigger a pivoting motion of the clamp 29 about a shift axis 143, which is produced by activating a button 44.

The sun gear 30 is furthermore arranged in the region of the axis of rotation 31 of a ring gear 32, whose nontoothed external surface 32*a* is coordinated with a second clamp 33. The axis of rotation 31 is identical to or aligned with the tensioning axis 6*a*. The clamp 33 interacting with the outer surface 32*a* can essentially be configured in the same way as the first clamp 29 as a shifting cam, which can move between two end positions, whereby in the one position the ring gear 32 is blocked against rotation and in the other position the ring gear 32 is released for rotational movements. Moreover, an internal toothing of the ring gear 32 engages with three planet gears 34, which are mounted at the end face of the following planet carrier 35, facing the ring gear 32. The planet gears 34 of the planet carrier 35 furthermore engage with the sun gear 30 of the input gear 23, which protrudes into the ring gear 32.

The locking device in the embodiment being described is configured so that always only one of the gears 25, 32 is clamped against rotation and the other gear 25, 32 is free for rotational movements. Thus, depending on the positions of the locking devices 29, 33, it is possible for a rotational movement of the gear 23 and the sun gear 30 to result in either a rotation of the planet carrier 35 about the tensioning axis 6*a* and axis of rotation 31 by virtue of a movement of the planet gears 34 in the internal toothing of the ring gear 32. Or the rotation of the sun gear 30 depending on the positions of the locking device results in a rotation of the ring gear 32. If the planet carrier 25 is not clamped by the locking mechanism, the rotating sun gear entrains the planet gears 25*b* so that the planet carrier 25 rotates and the ring gear 27 remains stationary. On the other hand, if the ring gear 32 is not clamped, a rotation of the sun gear 30 results in an entrainment of the planet gears 34, which in turn set the ring gear 32 in a rotational movement. Since the resistance to rotation in the further course of the planetary gearing 26 is greater toward the tensioning wheel 7 than the torque needing to be overcome in order to set the ring gear 32 in rotation, the ring gear 32 will primarily rotate in this case and the tensioning wheel 7 at least for the most part will not rotate.

At the other end face of the planet carrier 35, turned toward the tensioning wheel 7, there is arranged rotationally firm on the planet carrier 35 another sun gear 36, which meshes with planet gears 41 of another planet carrier 42. A further sun gear 43 directed toward the tensioning wheel 7 and connected rotationally firm to the planet carrier 42 is led through a recess of the additional planet carrier 37, configured as a ring gear. The sun gear 43 stands in meshing engagement with planet gears 38 of the additional planet carrier 37, facing the tensioning wheel 7 The planet gears 38 of the second planet carrier 37 mesh in turn with an internal toothing of the tensioning wheel 7 and drive the latter in its rotational movement about the tensioning axis 6*a*. This rotational movement of the tensioning wheel 7, provided with a fine toothing on its external circumferential surface, is utilized to grasp the strap B with the circumferential surface and pull back the strap of the strap loop, thereby increasing a strap tension in the strap loop.

The third planet carrier 37 has a shoulder 37*a* on its outer surface, which can be brought into contact against a stop element 39 by a rotational movement. The stop element 39 itself is fixed not to the rocker, but to the base plate 4 or some other carrier, which does not participate in the pivoting motion of the rocker 8. Thus, the stop element 39 is stationary in regard to the shoulder 37*a*.

In use when strapping packaged goods, the strapping device 1 behaves as follows: after a loop of a customary plastic strap has been placed around the particular packaged goods, this is placed inside the strapping device in the region of the end of the strap where the strap loop is double-ply for a certain length, and the end of the strap is secured in the strapping device by a strap clamp, not otherwise depicted. A section of the strap B immediately next to the strap loop is placed in double layer on top of the tensioning plate 9 of the tensioning apparatus 6. The rocker 8 with the tensioning wheel 7 and the upstream gearing 26 is situated in its upper end position, in which the tensioning wheel 7 is arranged at a spacing (by its greatest design spacing) from the tensioning plate 9, so that the largest possible opening gap is produced, enabling an easy, comfortable and thus also rapid placement of the strap in the tensioning apparatus. After this, the rocker is lowered onto a tensioning plate 9 opposite the tensioning wheel 7 and pressed against the strap arranged between the tensioning plate 9 and the tensioning wheel 7. Both this transfer movement of the tensioning wheel and the magnitude of the pressing force exerted on the strap by the tensioning wheel at the start of the tensioning process can be produced in the described embodiment of the present disclosure by one or more prestressed spring elements 44 (not shown). By activating a button 10, the spring element can be released and the entire strapping process triggered with its consecutive steps of "tensioning", "closing", "cutting", releasing the tension of the strap in the region of the tensioning apparatus, and "lifting of the rocker", for which no further intervention by the user of the strapping device need occur.

Figure 10:
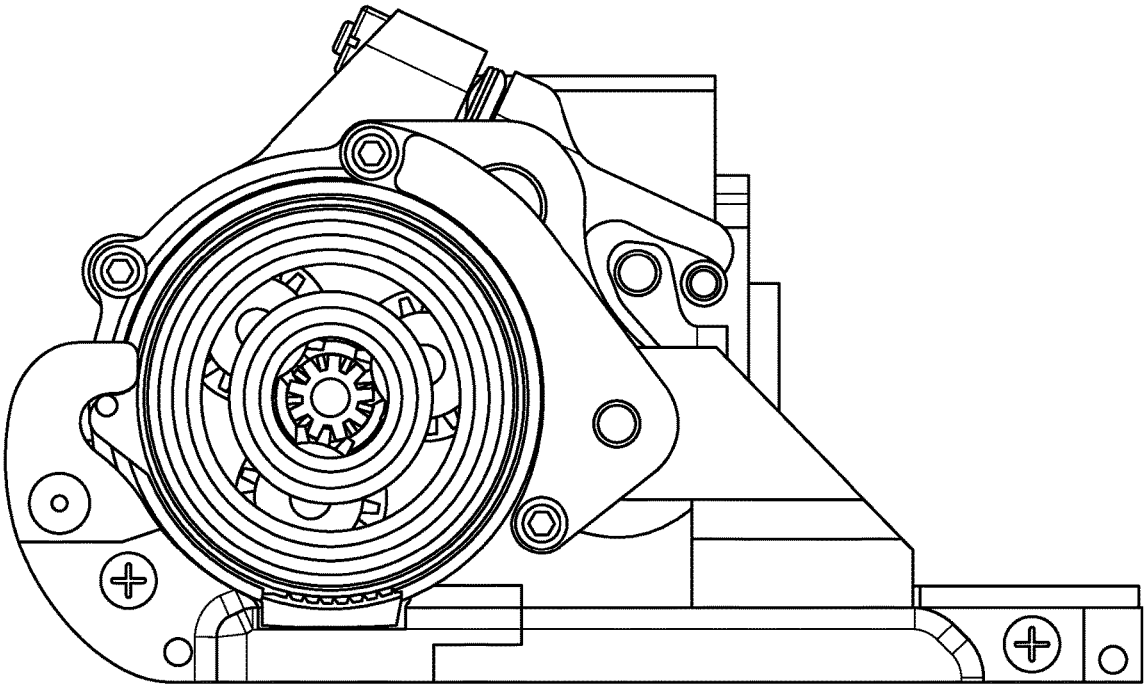
FIG. 10 a side view of the tensioning apparatus of FIG. 2, in which the rocker is located in a position with large pressing force against a tensioning plate.
Figure 11:
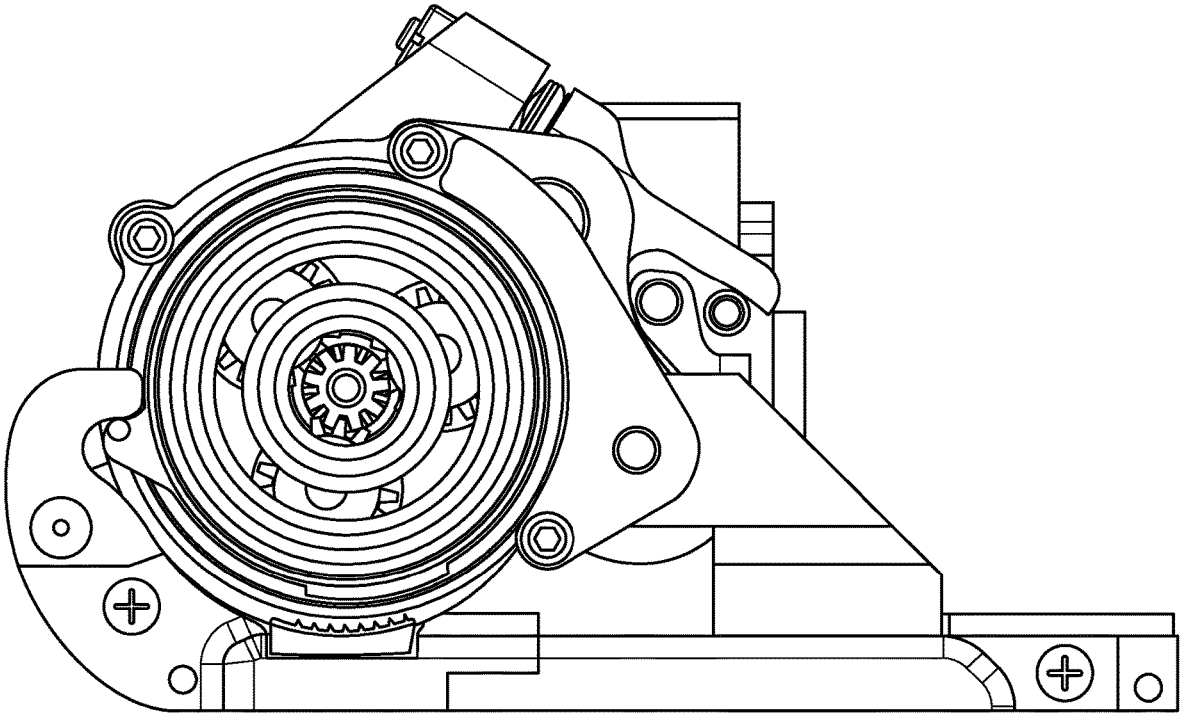
FIG. 11 a side view of the tensioning apparatus of FIG. 2, in which the rocker is located in a position with less pressing force against a tensioning plate as compared to FIG. 10.

After the tensioning wheel 7 is moved automatically from the open position to its tensioning position (see the tensioning position in FIG. 10 and the open position in FIG. 11), where the tensioning wheel 7 lies on the strap B and presses across the strap on the tensioning plate 9, the motorized driving movement is transmitted to the tensioning wheel 7. Now the second clamp 33 is moved into its position in which the second clamp 33 presses against the ring gear 32. The ring gear 32 is thereby arrested from rotational movements and locked. The first clamp 29, on the other hand, continues to be positioned at a spacing from the input planet carrier 25 and releases the ring gear 27 for rotational movements. The motorized driving movement, which thanks to the particular designated rotary direction of the motor M is transmitted via the bevel gearing 19, 20, 21 to the second toothed belt drive 22 and thus to the gear 23, goes from here in the sequence of the following mentioned gearing elements via the input gear 23, the sun gear 30, the planet gears 34, the sun gear 36, the planet gears 41, the sun gear 43 and via the planet gears 38 to the tensioning wheel 7. The tensioning wheel 7 can be driven by the multistage planetary gearing in greatly stepped-down rotational movement of the motor and thus when necessary with correspondingly high torque in the predetermined rotary direction.

In the just described "tensioning" operating state of the strapping device, the driven tensioning wheel 7 in engagement with the strap produces a corresponding, oppositely directed counterforce on the tensioning wheel 7, depending on the resistance resulting from the strap tension and acting on the tensioning wheel 7. This counterforce acts in the reverse direction of transmission of the motorized driving movement on all gearing elements of the multistage planetary gearing that are involved in the transmission of the driving movement. If a different type of gearing from a single or multiple-stage planetary gearing is used, the counterforce resulting from the already applied strap tension and put into the respective gearing via the contact with the tensioning wheel is also available for use in accordance with the present disclosure. According to the present disclosure, this counterforce can be used to improve the conditions of the process, especially the functional safety even when the applied strap tension is high. Thus, in order to use this counterforce for the following described purpose, it would be possible in theory to use each of these gear elements for this, in particular, to pick off and employ the mentioned counterforce at each of these gear elements.

In the sample embodiment, the planet carrier 37 is used for this. The planet carrier 37 is buttressed in this case via the stop element 39 against the base plate 4, so that the entire tensioning apparatus 6 is pressed about the rocker axis 8*a* against the strap in proportion to the force of resistance (strap tension). The tensioning wheel 7 is thus pressed against the strap B proportionally to the strap tension. The strap tension generated by the tensioning process is utilized in advantageous manner to increase the pressing force of the tensioning wheel 7 on the strap B as the strap tension increases steadily, so that the danger of a "slip-through" or a slippage of the tensioning wheel 7 during the tensioning process, which also increases with increasing strap tension, can be counteracted.

Figure 3:
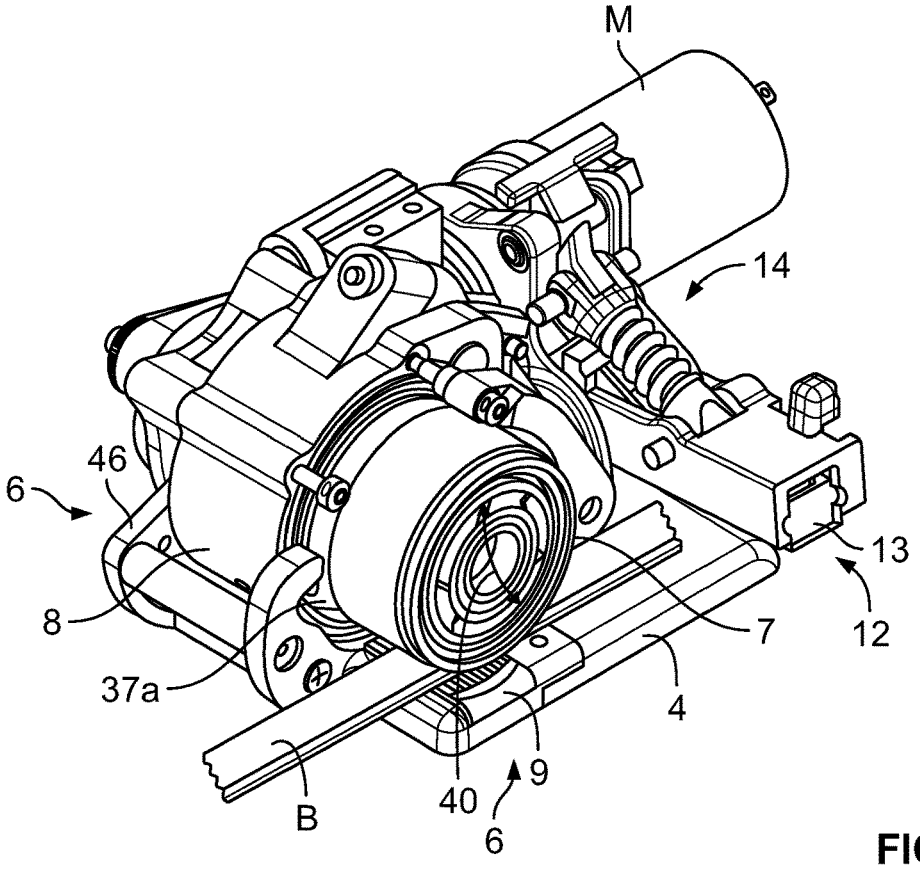
FIG. 3 a perspective representation of the tensioning and closure mechanism of the strapping device from FIG. 1.

For this, the planet carrier is configured with the engaging element 37*a*, which interacts with the stationary stop element 39. The engaging element, configured as a cam and arranged on the outer circumference of the planet carrier and projecting essentially radially from it, is buttressed against the stop element 39. As can be seen from FIG. 3, for this purpose the stationary stop element 39 is located in the region of the head end of the strapping devices. The stop element 39 in the sample embodiment shown is situated on one side, namely, the head end, of the tensioning axis 6*a* and the rocker pivot axis 8*a* running essentially parallel to it is on the other side of the tensioning axis 6*a*. The rocker 8, on which the planet carrier 37 is arranged via a roller bearing and able to rotate about the tensioning axis 6*a*, is also able to swivel at least during the tensioning process, i.e., it is not blocked against pivoting motions but instead released for these. Furthermore, the planet carrier 37 is able to rotate during the tensioning process about the tensioning axis 6*a*. The strap tension created in the strap B as a reaction to the tensioning process brings about a force on the tensioning wheel 7 which is opposite the rotary direction of the tensioning wheel provided during the tensioning process. This reaction force acts from the tensioning wheel via the planet carrier 37 on the rocker 8 as a torque directed about the rocker pivot axis 8*a*, by which the planet carrier 37 is pressed with increased force against the strap in the direction of the tensioning plate 9. The higher the strap tension already produced in the strap, the higher the torque resulting from this and from the motorized driving movement continuing to act on the tensioning wheel 7. This torque, arising as a reaction, is in turn proportional to the resulting pressing force acting from the tensioning wheel 7 on the strap B, with which the strap B is pressed by the tensioning wheel 7 against the tensioning plate 9. Therefore, in the present disclosure, an increasing strap tension from the motorized driving movement on the tensioning wheel 7 goes hand in hand with an increasing pressing force of the tensioning apparatus on the strap.

After the ending of the tensioning process and the following welding process to form the closure and also after a motorized driven cutting process by a cutting device, not otherwise depicted, integrated in the strapping device, a quick and uncomplicated removal of the strap from the strapping device should be possible. To accomplish this, there is provided a motorized lifting movement of the tensioning wheel 7 from the clamping position. For this, the button is activated and for as long as the button 10 is activated the rocker also remains in the open position, in which a sufficient spacing is created between the tensioning plate 9 and the tensioning wheel 7. By releasing the button 10, the rocker is closed, for example, by spring force.

In the sample embodiment, to accomplish this at first the operative connection between the electric motor M and the tensioning wheel 7 is released and an operative connection is created between the electric motor M and the rocker 8. This is accomplished by switching the clamps 29, 33. The previously existing clamping of the ring gear 32 is lifted in that the second clamp 33 is removed from the outer surface 32*a* of the ring gear 32 and in this way the ring gear 32 is released for rotational movements. Basically at the same time or shortly thereafter, the first clamp 29 is lowered onto the clamping surface 25*a* of the planet carrier 25 and brought to bear against it in clamping fashion. In this way, the input planet carrier 25 is fixed and locked against a rotational movement about the tensioning axis 6*a*, along which the entire planetary gearing is situated.

In this way, the tensioning wheel 7 can turn freely without being driven and no longer has an operative connection to the electric motor M or the sun gear 30, such as might transmit a driving movement. A driving movement of the electric motor M with the same rotary direction as during the tensioning process is now utilized, thanks to the locking of the input planet carrier 25 of the planetary gearing, so that the planet gears 25*b* of the spur gear 25 entrain the input ring gear 27 in their rotational movement. The input ring gear 27 thus executes a rotational movement by virtue of the rotating planet gears 25*b*. The bearing and abutment of the ring gear 27 on the abutment element 46 leads to a pivoting motion of the ring gear 27 about the rocker axis 8*a*. The input ring gear 27, which is also connected rotationally firm to the rocker 8 thanks to the clamping, entrains the rocker 8 during this movement. This results in a lifting of the rocker 8 and the tensioning apparatus 6 secured to it, including the tensioning wheel 7. The rotational movement of the rocker 8 can be limited by an end stop or an end position sensor, which shuts off the motor M after reaching an end position in the opened position of the rocker 8 and triggers an arresting of the rocker. Thanks to the motorized lifting movement of the rocker 8 against the direction of action of the spring element 44, the spring element 44 also is once more provided with a greater prestressing force. The strap B can now be removed from the strapping device 1.

The strapping device is now ready for a new strapping process, which can occur in the same way as the previously described strapping process. In order to lower the rocker 8 after introducing a new piece of strap B in the strapping device 1, the spring element 44 must be released again, which can be done for example via an operator button on the strapping device. In the sample embodiment, the previously actuated button 10 is released for this. The spring force then swivels the rocker, now in the opposite direction, against the tensioning plate and clamps the strap for the next tensioning process with an initial pressing force between the tensioning wheel 7 and the tensioning plate 9. The variable pressing force in the rest of the tensioning process increases in the manner described.

In FIGS. 5 to 9 is shown another sample embodiment of a strapping device according to the present disclosure. In regard to its external appearance, this can also correspond to the representation of FIG. 1. The basic layout of this embodiment of the strapping device can also correspond to that of the previously discussed embodiment of the present disclosure. Accordingly, in this embodiment as well, only a single motor M is used, which is provided to drive the welding mechanism 12 and separating mechanism (not shown in FIG. 5) in one of the two directions of rotation of the motor on the one hand and the tensioning apparatus 6 on the other hand in the other direction of rotation of the motor. The optional driving of either the welding mechanism and separating mechanism on the one hand or the tensioning apparatus 6 on the other hand is done via a freewheeling and different directions of rotation of the motor M.

The embodiment likewise shows a pivoting rocker 80 of the tensioning apparatus 86, driven by motor about a rocker pivot axis 80*a*. In contrast with the previously explained sample embodiment, here it is not the tensioning wheel 87 but instead the tensioning plate 89 which is arranged on the pivoting rocker 80, whose rocker pivot axis 80*a* runs parallel to the tensioning axis 86*a*. The motorized driving movement with the direction of rotation which is used for rotational movements about the tensioning axis 86*a* is also used in this sample embodiment for the pivoting motion of the rocker 80. The rocker pivot axis 80*a* in this embodiment as well runs essentially parallel to the tensioning axis 86*a*, about which the tensioning wheel can rotate. The rotational movement of the motor is transmitted, behind a point at which the motorized driving movement is utilized for the welding mechanism, across a bevel gear pair 99, 100 to a planetary gearing 106 and from this it goes further to the tensioning wheel 87. A freewheeling 125 arranged on the shaft of an input sun gear 110 ensures that the input side of the planetary gearing 106 can only turn in one rotary direction. The planetary gearing 106 is provided with gear elements which can be optionally arrested by way of a locking mechanism having two clamps 29, 33, as in the previously described sample embodiment, so that the driving movement can be transmitted either to the tensioning wheel 87 or to the rocker 80.

In order to open the tensioning apparatus 86, the ring gear 107 is released via the locking device, i.e., the clamp 33 is not in clamping engagement with the ring gear 107. The tensioning wheel 87 can in this way turn freely without an operative connection with the motor M. Optionally, strap tension still acting on the tensioning wheel 87 from the strap B from the previous tensioning process is released in this way by the tensioning wheel 87 and the gearing 106 upstream from the tensioning wheel. With the clamp 29, the spur gear configured as a planet carrier 105 is locked, and its axis of rotation is aligned with the tensioning axis 86*a*, i.e., the axis of rotation of the tensioning wheel 87. The motorized driving movement transmitted from the bevel gear 100 to the input sun gear 110, thanks to the removable rotary arresting of the planet carrier 105 performed by way of the clamp 29, does not lead to a rotation of the planet carriers 105 but instead to rotational movements of the planet gears 105*b* of the planet carrier 105. The internal toothing of the ring gear 109 which engages with these planet gears 105*b* places the latter in rotational movement. As is especially seen in FIG. 7, an external toothing 109*c* of the ring gear 109 engages with an external toothing 150*c* of a circular arc segment 150, which is disposed stationary on one end of a connection shaft 151. The connection axis 151*a* of the connection shaft 151 runs parallel to the stationary tensioning axis 86*a* of this sample embodiment. Instead of the two external toothings 109*c*, 150*c*, the ring gear 109 could also be braced by a cam against an abutment element, in which case either the cam or the abutment element is neither fastened to the ring gear 109 nor movable in design and the other of the two elements should be disposed on the ring gear 109.

The rotational movement of the ring gear 109 and the engagement of the ring gear 109 with the circular arc segment 150 results in a rotational movement of the connection shaft 151 about the connection axis 151*a*. A spur gear 152 arranged at the other end of the connection shaft 151 engages with an external toothing 117*c* of the planet carrier 117 and in this way transmits the rotational movement about the connection axis 151*a* to the planet carrier 117. In relation to the tensioning axis 86*a*, the connection axis 151*a* is situated on one side and the rocker pivot axis 80*a* on the other side of the tensioning axis 86*a*, the rocker pivot axis 80*a* being located on the side of the head end of the strapping device.

The planet carrier 117 belongs to the drive train provided for the driving movement of the tensioning wheel 87. The operative connection of this drive train to the motor M is momentarily broken thanks to the above described shifting process of the locking mechanism. Thus, at the above-described moment in the process there is no operative connection of the motor M with the tensioning wheel 87 to drive the latter. As a result of the rotary movement transmitted to the planet carrier 117, the planet carrier 117 rotates about the tensioning axis 86*a* and entrains a dog 80*c* of the rocker 80 by a cam 117*a* arranged on its outer circumferential surface. As a result, the rocker 80, appearing as an arc in plan view, is rotated and opened.

The rocker 80, able to turn about the rocker axis 80*a* and having the approximate shape of an arc segment, is arranged with its lower free end underneath the tensioning wheel 87, so that the tensioning plate 89 arranged in the region of the free end of the rocker 80 can likewise be arranged directly beneath the tensioning wheel 87. In order to arrange the tensioning plate 89 with a spacing from the tensioning wheel 87, the previously described motorized driven movement of the rocker 80 is used in the rotary direction along arrow 112 (FIG. 6), by which the rocker 80 is opened as described and a spacing between the tensioning wheel 87 and the tensioning plate 89 is increased. The opening movement can be limited by an end stop. The motor-opened rocker 80 now enables a removal of the tensioned and closed packaging strap from the strapping device. After the finished strapping is removed, the end of a new strapping loop for the next tensioning process can be introduced between the tensioning plate and the tensioning wheel. The rocker 80 can be brought back once again to the tensioning wheel by the restoring force of the spring element 124 previously stretched during the opening movement and press the strap against the tensioning wheel with an initial pressing force for the tensioning process. In order to utilize the spring force and thereby move the rocker 80 in a rotary direction along arrow 113 in the direction of the tensioning wheel 87, an activation of a button or some other activating element can be provided, by which the spring force is released to act on the rocker. This can also involve a releasing of the button 10.

In order to tension the strap B arranged between the tensioning wheel 87 and the tensioning plate 89, the ring gear 107 is clamped on its outer circumferential surface by way of the clamp 33 to prevent rotational movements. The planet carrier 105 is not clamped, and so it can turn, as can the connection shaft 8. The motorized driving movement from the sun gear 30 in the planetary gearing 106 arranged on the tensioning axis 86*a* is transmitted through the planet carrier 105 and the ring gear 107 to the planet gears 114 of the second planet carrier 115 and sets the latter in rotation. A sun gear, not recognizable in the representation of FIG. 5, drives the planet gears 121 of an additional downstream stage of the planetary gearing 106. The planet carrier 122 of this stage also rotates. The sun gear 123 of the last-mentioned stage is further led through the additional planet carrier 117 and drives the planet gears 118 of this additional stage, which in turn are in engagement with an internal toothing of the tensioning wheel 87. The tensioning wheel 87 is thus driven in the tensioning direction across the single or multiple-stage planetary gearing 106 and the inserted strap B is tensioned.

In the previously described operating mode of "tensioning", in which the tensioning wheel 87 engages with the strap B, a force of resistance in the form of a restoring moment acting from the strap B on the rotating tensioning wheel 87 is produced by virtue of the strap tension. Its magnitude is variable and proportional to the magnitude of the applied strap tension. This force of resistance works opposite the motorized driving moment which arises in the gear elements participating in the transmission of the driving movement. In the sample embodiment, the planet carrier 117 is braced by a cam 117*b*, having the function of an end stop, against the rocker 80. The planet carrier 117 rotating by the motorized driving movement in a suitable rotary direction lies by its cam 117*b* against a dog 80*b* of the rocker and thereby turns it in a motion according to arrow 113 (FIG. 6) about the rocker axis 80*a* against the tensioning wheel. Optionally, a noticeable rotary movement about the rocker axis 80*a* will not actually be executed here, but essentially only the torque about the rocker axis 80*a* is increased. In either case, however, the pressing force by which the rocker 80 presses the tensioning plate 89 or the strap against the tensioning wheel 87 is increased. This increase generally does not occur in a single step. The increasing of the pressing force of the rocker against the strap, ultimately stemming from the motorized driving movement and the already existing strap tension and occurring by engaging with the tensioning gearing 106, occurs proportionally to the resistance and restoring force present in the strap and acting as a resistance force against a maintaining and a further increasing of the strap tension at the point of engagement with the strap, from the strap to the tensioning plate 89 and on the tensioning wheel 87. As long as an increasing of the strap tension is occurring by the tensioning process, so too will the resistance force increase and thus the pressing force resulting from it.

Figure 8:
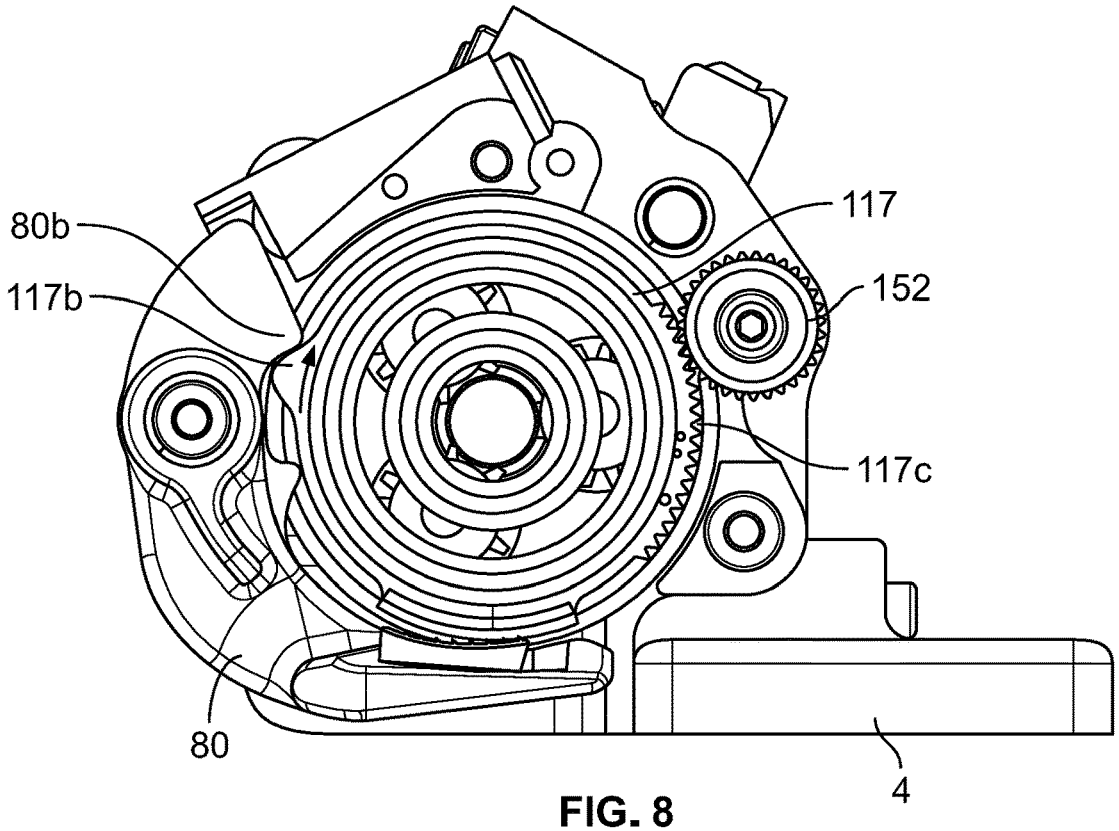
FIG. 8 a side view of the tensioning apparatus from FIG. 5, in which a rocker is located in a first pivot end position.
Figure 9:
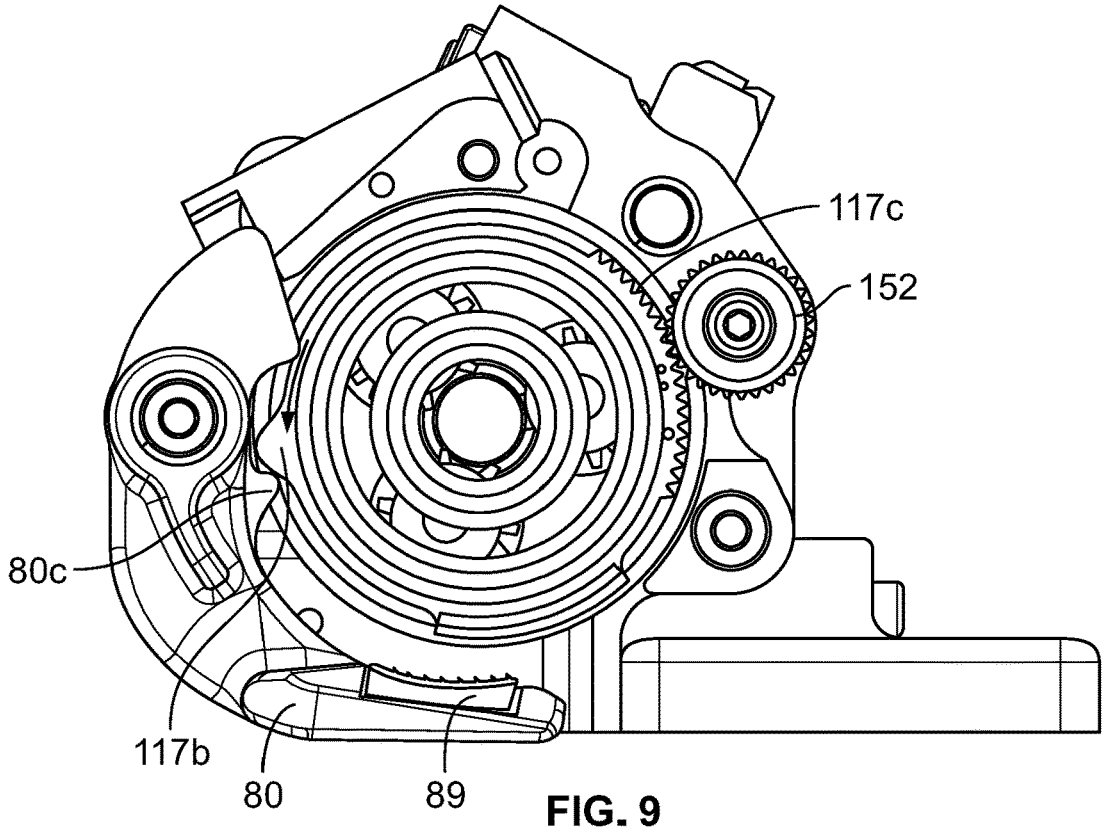
FIG. 9 a side view of the tensioning apparatus of FIG. 5, in which the rocker is located in a second pivot end position.

In FIGS. 8 and 9 are shown the end positions of the rocker 80 which are possible on account of the swiveling ability of the rocker to open and close on the one hand and to increased the pressing force on the strap on the other hand. As shown in FIG. 8, in one of the two end positions the tensioning plate 89 by virtue of a contacting of the cam 117*b* of the planet carrier 117 with a contour of the dog 80*b* and a clockwise rotational direction of the planet carrier (in relation to the representation shown in FIG. 8) rotates the rocker counterclockwise about its rocker pivot axis. The dog 80*b* and the cam 117*b* in this case act like a lever, which produces a counterclockwise torque about the rocker pivot axis 80*a*.

FIG. 9 shows the end position of the opened rocker. Here, the planet carrier 117 turns in the opposite rotary direction as compared to FIG. 8 and thereby comes to bear against the dog 80*c* of the rocker 80. The dog 80*c* is situated in regard to the rocker pivot axis 80*a* and the other dog 80*b* on the other side of the rocker pivot axis 80*a*. In the position of use of the strapping device with a horizontal orientation of the base plate, the dog 80*b* is situated above and the dog 80*c* below the rocker pivot axis 80*a*. In this way, the rocker swivels clockwise in the representation of FIG. 9 and thereby creates a spacing from the tensioning wheel 87.

Figure 12:
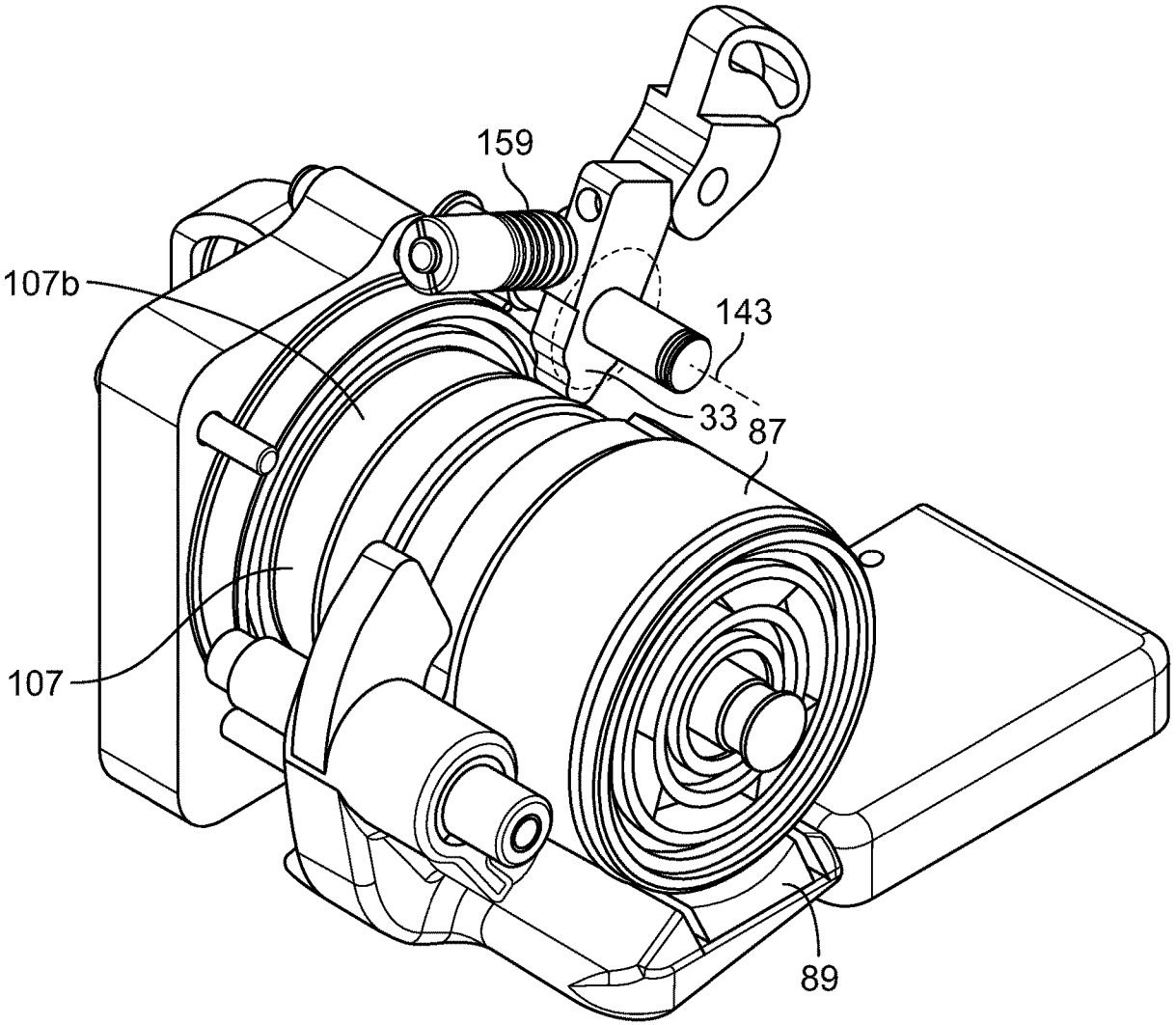
FIG. 12 a partial perspective representation of the tensioning and closure mechanism.
Figure 13:
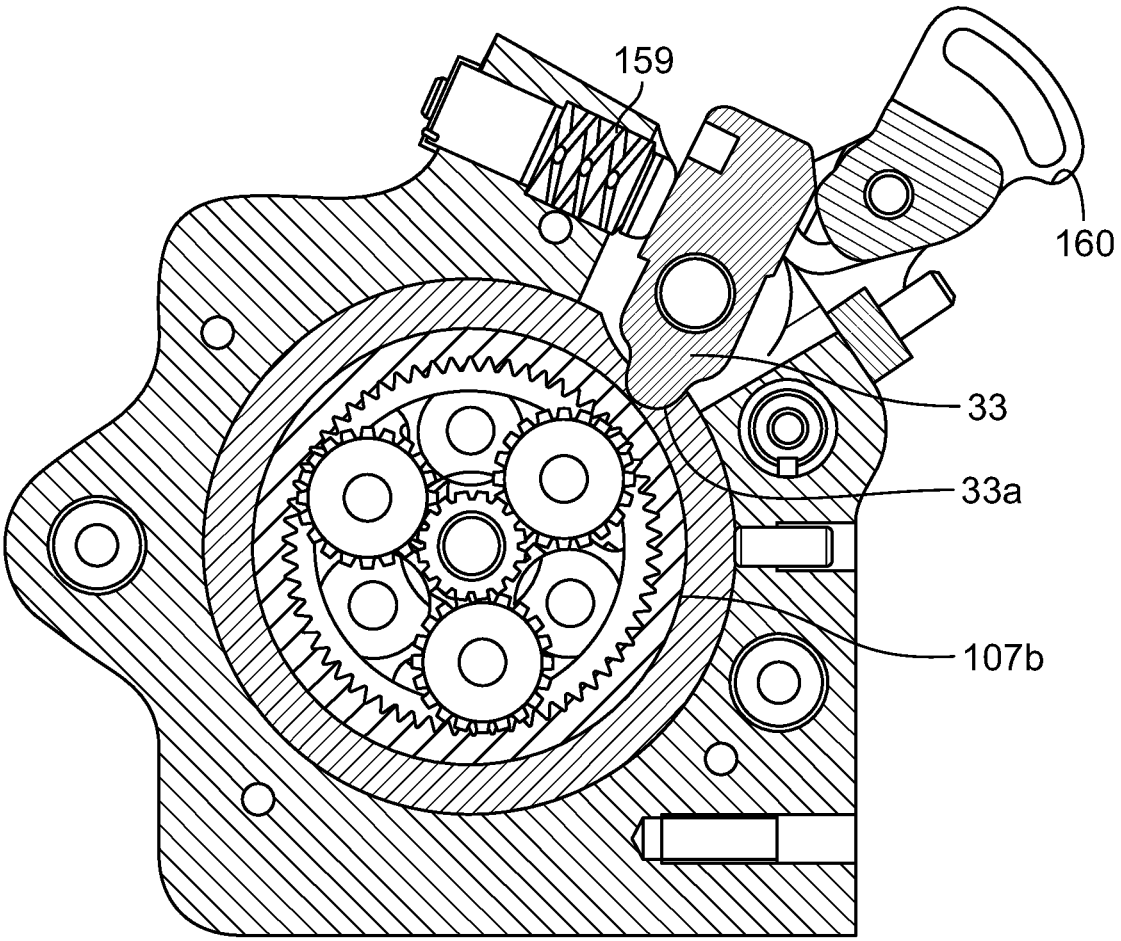
FIG. 13 a sectional representation of the tensioning and closure mechanism.

FIG. 12 shows a partial perspective view of the tensioning apparatus of the second sample embodiment, in which only one of the two clamps is depicted. Here, the clamp 33 is brought to bear against the flat circumferential surface 107*b* of the ring gear 107, which is essentially round in cross section. FIG. 13 shows a sectional representation through the ring gear 107 and the clamp 33. By way of the clamp 33 of the locking mechanism, the ring gear can be optionally clamped against rotational movements or released again. Each of the clampings provided in the strapping devices of FIG. 2-11 can be configured according to the locking mechanism described here, however traditional locking mechanisms are also possible. In the clamping according to the present disclosure, an at least approximately planar circular or circular arc-shaped circumferential surface of the gear interacts with a pivoting clamping element or clamping body. The circumferential surface 107*b* of the sample embodiment shown, functioning as a clamping surface, has no detent elements with which a clamping is provided that is based on a form-fitting engagement of a clamping element with a detent element or a detent recess.

The clamping element 33 is mounted so that it can pivot about the shifting and pivoting axis 143, where the shifting axis 143 of the clamping element 33 runs parallel to the axis of rotation of the gear 107 being clamped. The shifting axis 143 runs in the region of one end of the camlike clamping element 33. In the region of the other end of the clamping element there is provided an arc-shaped contact surface 33*a*, which is provided for a contact with the clamping surface 107*b* of the gear being clamped. Due to the circular shape of the clamping surface 109*b* as well as the arc shape of the contact surface 33*a* inside view, an essentially linear contact comes into being when the clamping element 33 contacts the circumferential surface 107*b*, and this line of contact runs perpendicular to the plane of the drawing in FIG. 13.

As emerges from FIG. 13, the clamping element 33 is arranged in relation to the gear 107 being clamped such that the line of contact of the contact surface 33*a* has a distance 155 from its pivot axis 143 which is greater than the distance of the pivot axis 143 from the clamping surface 107*b*. As a result, during a pivoting motion of the clamping element 33 from its release position to a clamping position it already comes into contact with the clamping surface 107*b* at a point which lies before a line of connection 156 of the axis of rotation of the gear 107 to the pivot axis 143 of the clamping element. In relation to the intended rotary direction 157 of the gear 107 being clamped, the line of contact occurs before the (imaginary) line of connection 156. The rotation of the gear 107 is braked and can at most still move just a little Thanks to a further rotation against the increasing clamping action, the clamping action is further intensified and an increasing wedging of the clamping element 33 against the gear 107 is intensified. Thanks to these geometrical relations, the clamp 33 cannot pass the line of connection 156 in rotary direction of the gear, its pivoting motion halts before the line of connection 156 and presses against the clamping surface 107*b*. In an end position essentially corresponding already to the position of first contact with the clamping element 33, the gear 107 is clamped against the camlike clamping element 33. No further movement is possible, regardless of how high the torque is.

Figure 14:
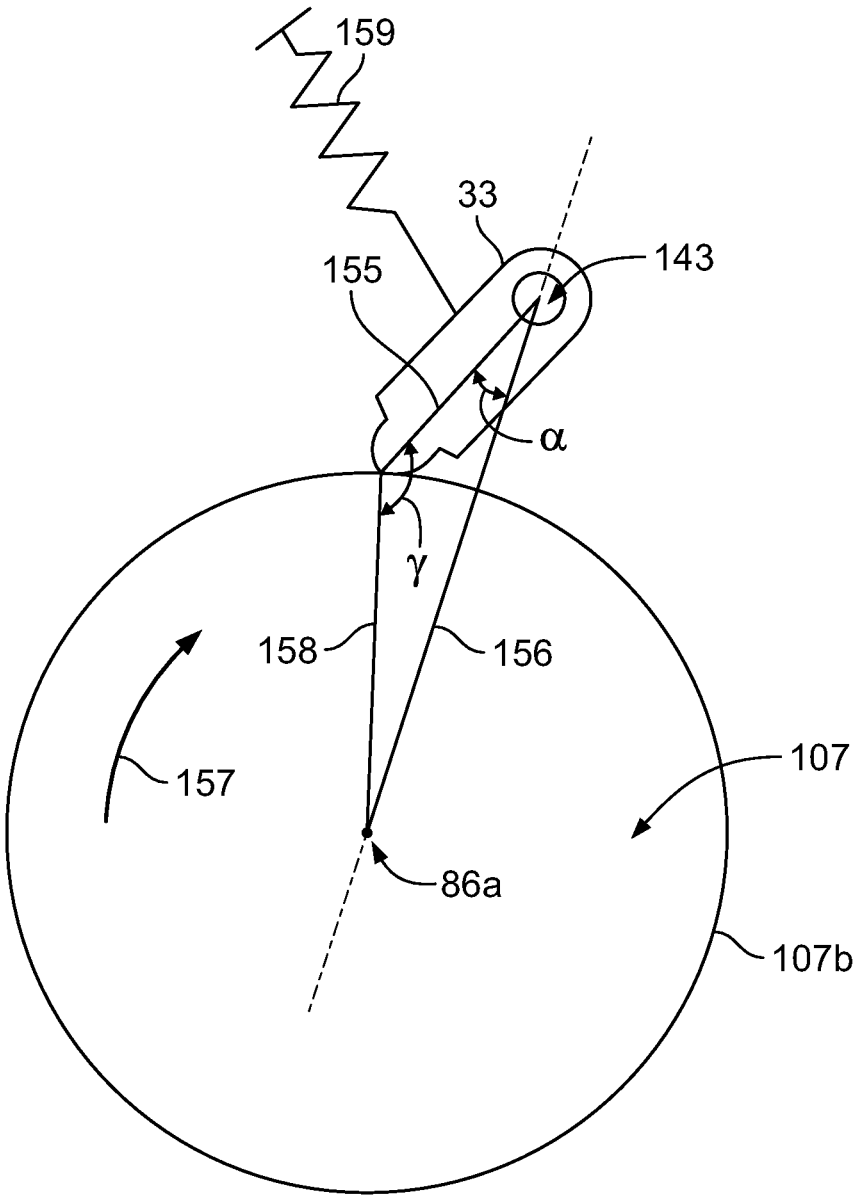
FIG. 14 a schematic diagram of the geometrical relations of a strapping device.

FIG. 14 shows the geometrical relations of the clamping. Here as well, the connection between the axis of rotation 86*a* of the gear 107 and the pivot axis 143 is designated as 156. The contact surface (circumference) of the gear could be smooth or structured. The radius of the gear at the contact site with the cam is designated as 158 and the pivot radius of the clamping element 33 at the contact site is 155. The pivot radius 155 at the contact site subtends an angle $\alpha$ with the line of connection 156, and the radius 158 of the gear 107 an angle $\gamma$ with the swivel radius 155 (each time at the contact site). In the sample embodiment, the geometrical relations are such that in the clamping position, in which the gear 107 is blocked against rotational movements in the intended rotary direction, the angle $\gamma$ is at least approximately 155°. In experiments it was also possible to achieve good results when using an angle from the range of 130° to 170°, especially from 148° to 163°. The angle $\alpha$ should advantageously be greater than or equal to 7°. In the sample embodiment, it is 9°. In other embodiments, it can also be chosen from a range of 7° to 40°.

In the sample embodiment of the present disclosure discussed here, it is not absolutely necessary, if the wedge effect is strong enough, to maintain the position of the cam in its clamping position by outside measures. This already occurs simply due to the fact that the gear 107 can only turn in one rotary direction and this is in fact blocked in removable fashion by the clamp 33. In sample embodiments of the present disclosure, the camlike clamping element is held in position by the spring force of a spring element 159. For this, the spring element 159 lies against the clamping element above the shifting axis 143 and turns or holds the clamping element 29 in its clamping position. In order to remove the clamping element from its clamping position, the spring force must be overcome with a switch 160. Using the switch 160, both clamps 29 and 33 can be activated at the same time. Depending on the arrangement of the switch/button, a pulling or pressing of the switch can overcome the spring force and release the ring gear 107 from the clamp 33 and lock the planet carrier 105. In the other movement of the switch/button, the clamp 29 and the planet carrier 105 are again released via the spring force, while the clamp 33 locks the ring gear 107.

LIST OF REFERENCE SYMBOLS

1 strapping device
2 housing
3 handle
4 base plate
6 tensioning apparatus
6*a* tensioning axis
7 tensioning wheel
8 rocker
8*a* rocker pivot axis
9 tensioning plate
10 button
12 friction welding mechanism
13 welding shoe
14 transmitting mechanism
15 storage battery
19 bevel gear
20 bevel gear
21 gear
22 toothed belt drive
23 gear
24 shaft
25 planet carrier
25*a* clamping surface
25*b* planet gears
26 gearing
27 ring gear
27*a* shoulder
27*c* cam
28 roller bearing
29 first clamp
29*a* arc-shaped contact surface
30 sun gear
31 axis of rotation of gearing and tensioning wheel
32 ring gear
32*a* outer surface
33 second clamp
34 planet gear
35 planet carrier
36 sun gear
37 planet carrier
37*a* shoulder
38 planet gear
39 stop element
40 arrow
41 planet gear
42 planet carrier
43 sun gear
44 spring element (restoring spring)
45 freewheeling
46 abutment
46*a* recess
80 pivoting rocker
80*a* rocker pivot axis
80*b* dog
80*c* dog
86 tensioning apparatus
86*a* tensioning axis
87 tensioning wheel
89 tensioning plate
99 bevel gear
100 bevel gear
105 spur gear (planet carrier)
105*b* planet gear
106 gearing
107 ring gear
107*b* circumferential surface
109 ring gear
109*b* circumferential surface
109*c* external toothing

110 sun gear
112 arrow
113 arrow
114 planet gears
115 planet carrier
117 planet carrier
117*b* toothing
117*a* cam
117*b* cam
117*c* toothing
118 planet gear
121 planet gear
122 planet carrier
123 sun gear
124 spring element
125 freewheeling
143 shifting axis
150 circular arc segment
150*c* toothing
151 connection shaft
151*a* connection axis
155 distance/swivel radius
156 connection line
157 rotary direction
158 radius
159 spring element
160 switch
B strap
M motor The invention is claimed as follows:

1. A strapping device comprising:

a base comprising a tensioning plate;

a rocker comprising a tensioning wheel rotatable about a tensioning-wheel axis, wherein the rocker is pivotable relative to the base about a rocker pivot axis;

a friction-welding device movable between a release position and a welding position; and a motor comprising a drive shaft operably connected to the rocker and the friction-welding device such that:

rotation of the drive shaft in a first rotational direction pivots the rocker relative to the base and about the rocker pivot axis to change a distance between the tensioning wheel and the tensioning plate; and rotation of the drive shaft in a second rotational direction opposite the first rotational direction moves the friction-welding device from the release position to the welding position.

2. The strapping device of claim 1, wherein the rocker is pivotable relative to the base and about the rocker pivot axis between a first position in which the tensioning wheel is a first distance from the tensioning plate and a second position in which the tensioning wheel is a second distance from the tensioning plate, wherein the first distance is less than the second distance.

3. The strapping device of claim 2, wherein the drive shaft is operably connected to the rocker such that rotation of the drive shaft in the first rotational direction pivots the rocker from the first position to the second position.

4. The strapping device of claim 3, further comprising a biasing element biasing the rocker to the first position.

5. The strapping device of claim 4, wherein the biasing element comprises a spring.

6. The strapping device of claim 5, wherein the friction-welding device comprises a weld shoe.

7. The strapping device of claim 6, further comprising first gearing operably connecting the drive shaft to the rocker and second gearing operably connecting the drive shaft to the friction-welding device.

8. The strapping device of claim 6, wherein the drive shaft is operably connected to the tensioning wheel to rotate the tensioning wheel about a tensioning axis and is operably connected to the weld shoe to oscillate the weld shoe.

9. The strapping device of claim 1, further comprising gearing operably connecting the drive shaft to the rocker, wherein the drive shaft is operably connected to the tensioning wheel via the gearing to rotate the tensioning wheel about a tensioning axis.

10. The strapping device of claim 9, further comprising one or more clamping elements movable from a first configuration to a second configuration to switch the gearing from a first state in which the gearing operably connects the drive shaft to the tensioning wheel so rotation of the drive shaft in the first rotational direction causes the tensioning wheel to rotate about the tensioning axis to a second state in which the gearing operably connects the drive shaft to the rocker so rotation of the drive shaft in the first rotational direction causes the rocker to pivot about the rocker axis.

11. The strapping device of claim 10, wherein the gearing comprises a first gear component and a second gear component, wherein when the gearing is in the first state the first gear component is rotatable and at least one of the one or more clamping elements prevents the second gear component from rotating, and wherein when the gearing is in the second state at least one of the one or more clamping elements prevents the first gear component from rotating and the second gear component is rotatable.

12. The strapping device of claim 11, wherein the rocker is pivotable relative to the base and about the rocker pivot axis between a first position in which the tensioning wheel is a first distance from the tensioning plate and a second position in which the tensioning wheel is a second distance from the tensioning plate, wherein the first distance is less than the second distance, wherein when the gearing is in the second state, rotation of the drive shaft in the first rotational direction pivots the rocker from the first position to the second position.

13. The strapping device of claim 11, wherein the one or more clamping elements comprise a first clamping element and a second clamping element, wherein the first clamping element is movable from a disengaged position in which the first clamping element does not prevent the first gear component from rotating to an engaged position in which the first clamping element prevents the first gear component from rotating, wherein the second clamping element is movable from a disengaged position in which the second clamping element does not prevent the second gear component from rotating to an engaged position in which the second clamping element prevents the second gear component from rotating.

14. The strapping device of claim 13, wherein the first gear component operably connects the drive shaft to the tensioning wheel, and wherein the second gear component operatively connects the drive shaft to the rocker.

15. The strapping device of claim 14, further comprising an actuating device actuatable to cause one of the first and second clamping elements to move from its disengaged position to its engaged position and the other of the first and second clamping elements to move from its engaged position to its disengaged position to switch the gearing from the first state to the second state.

16. The strapping device of claim 15, wherein the actuating device is actuatable to simultaneously cause the one of the first and second clamping elements to move from its disengaged position to its engaged position and the other of the first and second clamping elements to move from its engaged position to its disengaged position to switch the gearing from the first state to the second state.

17. The strapping device of claim 16, wherein the actuating device is actuatable to cause initiation of at least one of a tensioning process and a strap-connecting process.

18. The strapping device of claim 1, wherein the rocker is pivotably mounted to the base.

19. The strapping device of claim 18, wherein the rocker is pivotably mounted to the base so a torque is applied to the rocker during a tensioning process causes one of the tensioning wheel and the tensioning plate to exert a force on the other of the tensioning wheel and the tensioning plate.

20. The strapping device of claim 1, further comprising gearing operably connecting the drive shaft to the rocker and the friction-welding device, the gearing comprising free-wheeling that transmits a drive movement of the motor to the rocker and not to the friction-welding device when the drive shaft rotates in the first rotational direction and that transmits the drive movement of the motor to the friction-welding device and not to the rocker when the drive shaft rotates in the second rotational direction.

* * * * *